US008763291B1

(12) United States Patent
Nichols

(10) Patent No.: US 8,763,291 B1
(45) Date of Patent: Jul. 1, 2014

(54) SUPPORT DEVICE FOR ROLLABLE GRAPHICAL DISPLAY

(71) Applicant: John A. Nichols, Alpine, UT (US)

(72) Inventor: John A. Nichols, Alpine, UT (US)

( * ) Notice: Subject to any disclaimer, the term of this patent is extended or adjusted under 35 U.S.C. 154(b) by 32 days.

(21) Appl. No.: 13/624,707

(22) Filed: Sep. 21, 2012

Related U.S. Application Data

(60) Provisional application No. 61/538,568, filed on Sep. 23, 2011.

(51) Int. Cl.
*G09F 17/00* (2006.01)

(52) U.S. Cl.
USPC ..... 40/603; 40/124.07; 40/610; 40/789; 40/738; 40/124.06

(58) Field of Classification Search
USPC ..... 248/150, 152; 40/124.05, 124.07, 40/124.14, 124.15, 124.19
See application file for complete search history.

(56) References Cited

U.S. PATENT DOCUMENTS

| | | | | |
|---|---|---|---|---|
| 1,548,237 | A | 8/1924 | Ackermann | |
| 1,555,566 | A * | 9/1925 | Furste | 40/124.06 |
| 1,576,636 | A * | 3/1926 | Egan | 40/124.06 |
| 1,576,672 | A | 3/1926 | Miller | |
| 2,160,724 | A | 5/1939 | Alan | |
| 2,428,772 | A * | 10/1947 | Aranoff | 40/789 |
| 2,637,924 | A * | 5/1953 | Hutt | 40/124.06 |
| 2,862,322 | A | 12/1958 | Ziegler | |
| 3,488,872 | A | 1/1970 | Levy | |
| 3,971,149 | A | 7/1976 | Tanney | |
| 4,442,149 | A | 4/1984 | Bennett | |
| 4,679,554 | A | 7/1987 | Markham | |
| 4,945,706 | A | 8/1990 | Beaullieu | |
| 4,991,813 | A | 2/1991 | Beaulieu | |
| 5,151,078 | A * | 9/1992 | Lin | 493/405 |
| D343,299 | S | 1/1994 | Olivier | |
| 5,388,382 | A * | 2/1995 | Brooks | 40/610 |
| 5,439,043 | A | 8/1995 | Carter | |
| D369,924 | S | 5/1996 | Werner et al. | |
| 5,603,370 | A | 2/1997 | Boer | |
| 5,611,384 | A | 3/1997 | Carter | |

(Continued)

FOREIGN PATENT DOCUMENTS

FR 2598541 11/1987

OTHER PUBLICATIONS

US 7,516,521, 04/2009, Hammerslag (withdrawn).

(Continued)

*Primary Examiner* — Charles A Fox
*Assistant Examiner* — Shin Kim
(74) *Attorney, Agent, or Firm* — Workman Nydegger

(57) ABSTRACT

Support devices and graphic display systems in which the graphic display material is supported by a support device that is rollable with the flexible graphic display material, eliminating the need for traditional frames or stands. The support devices include a thin-walled elongate body having a length extending between first and second ends and having first and second side edges extending along the length of the elongate body. The side edges include at least one recess or protrusion for selectively locking the side edges together to selectively orient the elongate body in an elongate tube-shaped configuration when the side edges are selectively locked together. The thin-walled elongate body is sufficiently flexible so that when the side edges are disengaged from each other the elongate body can be rolled along its length into a tube-shaped configuration for storage.

34 Claims, 21 Drawing Sheets

(56) References Cited

U.S. PATENT DOCUMENTS

| | | | | |
|---|---|---|---|---|
| 5,617,662 | A | 4/1997 | Hwang | |
| 5,619,816 | A | 4/1997 | Ellison | |
| 5,632,390 | A | 5/1997 | Podergois | |
| 5,716,033 | A * | 2/1998 | Gibson | 248/95 |
| 5,778,580 | A | 7/1998 | Zarelius | |
| D396,559 | S | 8/1998 | Mullen | |
| 5,791,391 | A | 8/1998 | Carter | |
| 5,822,896 | A | 10/1998 | Milstein | |
| D406,699 | S | 3/1999 | Mullen | |
| 5,875,576 | A | 3/1999 | Kram et al. | |
| 5,903,993 | A | 5/1999 | Maticko et al. | |
| 5,934,599 | A | 8/1999 | Hammerslag | |
| 5,988,255 | A | 11/1999 | Wigglesworth, III | |
| 6,173,515 | B1 * | 1/2001 | Walsh | 40/124.08 |
| 6,202,953 | B1 | 3/2001 | Hammerslag | |
| 6,240,666 | B1 | 6/2001 | Apel et al. | |
| 6,289,558 | B1 | 9/2001 | Hammerslag | |
| D450,192 | S | 11/2001 | Whitcomb | |
| 6,347,772 | B1 | 2/2002 | L'Hotel | |
| 6,382,433 | B1 | 5/2002 | Podergois | |
| 6,449,891 | B1 | 9/2002 | Miska | |
| 6,594,934 | B1 | 7/2003 | Wong | |
| 6,643,966 | B2 | 11/2003 | Schmitt | |
| 6,718,669 | B1 | 4/2004 | Hayes | |
| 6,718,676 | B2 | 4/2004 | Miska | |
| 6,722,069 | B1 | 4/2004 | Lanier | |
| 7,020,993 | B2 | 4/2006 | Pritchard | |
| 7,100,317 | B1 | 9/2006 | Strong | |
| 7,134,230 | B1 | 11/2006 | Bones et al. | |
| 7,159,350 | B2 | 1/2007 | L'Hotel | |
| 7,171,772 | B1 | 2/2007 | Male | |
| 7,181,877 | B2 | 2/2007 | Quade | |
| 7,337,567 | B2 | 3/2008 | Fritsche et al. | |
| 7,392,609 | B1 | 7/2008 | Miska | |
| 7,437,842 | B2 | 10/2008 | Sgambellone | |
| 7,441,357 | B2 | 10/2008 | Steer | |
| 7,444,771 | B2 * | 11/2008 | Raccah | 40/466 |
| 7,490,426 | B2 | 2/2009 | Scarberry | |
| 7,591,050 | B2 | 9/2009 | Hammerslag | |
| 7,596,896 | B2 | 10/2009 | Crowell et al. | |
| D603,190 | S | 11/2009 | Hill et al. | |
| 7,647,715 | B2 | 1/2010 | Caravacci et al. | |
| 7,726,054 | B2 | 6/2010 | Mestres et al. | |
| 7,739,819 | B2 | 6/2010 | Hansen, Jr. | |
| 7,770,313 | B2 | 8/2010 | Fritsche | |
| 7,882,652 | B2 | 2/2011 | Elliott et al. | |
| 7,886,465 | B2 | 2/2011 | Virvo | |
| 7,920,326 | B2 | 4/2011 | Clawson et al. | |
| 7,941,950 | B2 | 5/2011 | Leeds | |
| 7,950,112 | B2 | 5/2011 | Hammerslag et al. | |
| 7,954,204 | B2 | 6/2011 | Hammerslag et al. | |
| 7,992,261 | B2 | 8/2011 | Hammerslag et al. | |
| 8,091,182 | B2 | 1/2012 | Hammerslag et al. | |
| 2005/0217154 | A1 | 10/2005 | Rodriguez | |
| 2007/0214690 | A1 * | 9/2007 | Pierce | 40/124.07 |
| 2008/0000123 | A1 | 1/2008 | Wilder | |
| 2008/0092417 | A1 * | 4/2008 | Crowell et al. | 40/124.07 |
| 2008/0178501 | A1 * | 7/2008 | Crowell et al. | 40/124.07 |
| 2008/0231815 | A1 | 9/2008 | Ganzevoort | |
| 2009/0300952 | A1 | 12/2009 | Hayes | |
| 2010/0011641 | A1 | 1/2010 | Hill | |
| 2010/0146832 | A1 | 6/2010 | Gimpel et al. | |
| 2010/0146834 | A1 | 6/2010 | Fritsche | |
| 2010/0180481 | A1 | 7/2010 | Parizek et al. | |
| 2011/0023378 | A1 | 2/2011 | Hogue | |

OTHER PUBLICATIONS

Images from Internet search results, based on information and belief, available at least as early as Mar. 11, 2011 (3 pages).

* cited by examiner

SUPPORT DEVICE FOR ROLLABLE GRAPHICAL DISPLAY

CROSS REFERENCE TO RELATED APPLICATIONS

This application claims the benefit of U.S. Provisional Patent Application No. 61/538,568, filed Sep. 23, 2011 entitled FRAMELESS ROLLABLE GRAPHICAL DISPLAY, the disclosure of which is incorporated herein in its entirety.

BACKGROUND OF THE INVENTION

1. The Field of the Invention

The present invention is in the field of displays, e.g., point of purchase displays, tradeshow displays, and other advertising displays.

2. The Relevant Technology

Often, advertising graphic materials are displayed at tradeshows, lobbies, or other venues through use of a frame structure that supports the graphic. Such frame structures are often bulky, heavy, and can be at least moderately difficult to set up and disassemble. In addition, even when disassembled, they are often not easily portable.

BRIEF SUMMARY

In one aspect, the present invention is directed to graphic display systems and support devices for supporting such graphic display systems in which the entire structure, including the graphic display material and any support devices that support it are rollable so that the entire system can be rolled-up for easy storage and transport. This advantageously negates the need for bulky frames or stands to support the graphic display material.

In one embodiment, the support device includes a thin-walled, elongate body extending between first and second ends and that includes first and second side edges extending along the length of the elongate body. The first and second side edges comprise at least one recess or protrusion to selectively orient the elongate body into an elongate tube-shaped configuration (e.g., substantially D-shaped) when the first and second edges are selectively locked together.

Opposing edges of the elongate body may be brought together, and then secured to one another in an interlocked configuration. A plurality of such elongate tube-shaped support devices may be employed to support the graphic display material of a graphic display system. When breaking down the system for transport or storage, the interlocking mechanism of the support devices may be disengaged, so that the support devices are rollable length wise with the graphic display material. Transportation and storage of such a system is greatly enhanced and simplified because the support structure is lightweight (e.g., an elongate thin-walled plastic sheet) and rollable with the graphic display material.

In one embodiment, the elongate body may include a plurality of transversely extending recesses formed along the length to assist the support device in assuming a curved configuration. Spacing between the recesses can be varied in order to provide a desired radius of curvature to the tube-shaped support device. Closer spacing between the recesses in any given region of the support device allows for a tighter radius of curvature.

Another embodiment is directed to a graphic display system including a thin-walled graphic display sheet (e.g., in the form of flexible, rollable paperboard or plastic sheet) that is sufficiently flexible so that the graphic display sheet can be rolled into a tube-shaped configuration during storage, and at least one support device as described above. Opposed side edges of the support devices may be selectively lockingly engaged with one another so as to provide tube-shaped support devices to which the graphic material may be attached to (e.g., using clips, adhesive, magnets, etc.). An exemplary system may include 4 support devices (e.g., two linear tube-shaped support devices along either side and two curved tube-shaped support devices along the top and bottom). Because the overall graphic display system thus assumes a curved configuration, it is able to stand on its own, supported on a floor using just the curvature of the bottom support device to provide stability. The body of the support members are flexible and rollable so that upon disengagement of the opposed side edges, each support member (now configured as a thin-walled elongate body) may be rolled-up lengthwise with the graphic display material for storage.

Another embodiment is directed to a method of setting up a graphic display system. Such a method may include providing a graphic display assembly in an initially rolled-up configuration. The graphic display assembly may include a rollable graphic display sheet and one or more rollable support devices for supporting the graphic display sheet in a desired configuration during use. The graphic display assembly is unrolled, the interlocking side edges of the one or more rollable support devices are engaged with one another to form one or more assembled support devices having a tube-shaped configuration. The one or more support devices may be attached to the graphic display sheet so as to maintain the graphic display sheet in an desired configuration during use.

One embodiment is directed to a ratchet device for applying tension to an elongate tensioning member. Such a ratchet device and elongate tensioning member may be used to maintain a curved support device in a desired curved configuration. Such a ratcheting device may include a handle including inwardly oriented projections and a central shaft including a proximal portion with teeth formed on an exterior surface thereof, a ratchet wheel including teeth configured to engage with the projections of the handle to allow rotation of the handle in only a single direction when the projections engage the teeth of the ratchet wheel; and a spool disposed about the central shaft of the handle. The spool may include a hollow channel for receiving the central shaft of the handle, and an interior surface of the spool may include teeth formed therein to selectively engage with the teeth of the central shaft of the handle. The teeth of the central shaft of the handle may selectively engage the teeth of the spool to allow an elongate tensioning member to be selectively spooled about the spool. Tension on the elongate tensioning member may be released by pulling the handle up relative to the spool so that the teeth of the central shaft disengage from the teeth of the spool.

These and other benefits, advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Introduction

In one aspect, the present invention is directed to graphic display systems in which the graphic display sheet and any supporting structure is rollable. Such systems negate the need for traditional frames or stands. Because the graphic display sheet and any support devices employed to support the shape are rollable along their length, the entire system is more easily packaged and shipped than existing systems. For example, all of the system components can be disassembled and quickly rolled-up into a tube-shaped configuration (e.g., and placed into an elongate rectangular or cylindrical tube) for easy transport or storage.

One embodiment of the present invention is directed to a support device for supporting a graphic display. The support device includes a thin-walled elongate body having a length extending between first and second ends and having first and second side edges extending along a length of the body. The side edges may include at least one recess or protrusion for selectively locking the first and second side edges together to selectively orient the elongate body into an elongate tube-shaped configuration (e.g., substantially D-shaped) when the first and second side edges are selectively locked together. The thin-walled, elongate body of the support device is advantageously sufficiently flexible so that when the side edges are disengaged from one another, the elongate body can be rolled along its length (e.g., with a flexible paper board or plastic graphic display sheet) into a tube-shaped configuration for storage.

II. Exemplary Support Devices and Graphic Displays

Figure 1A:
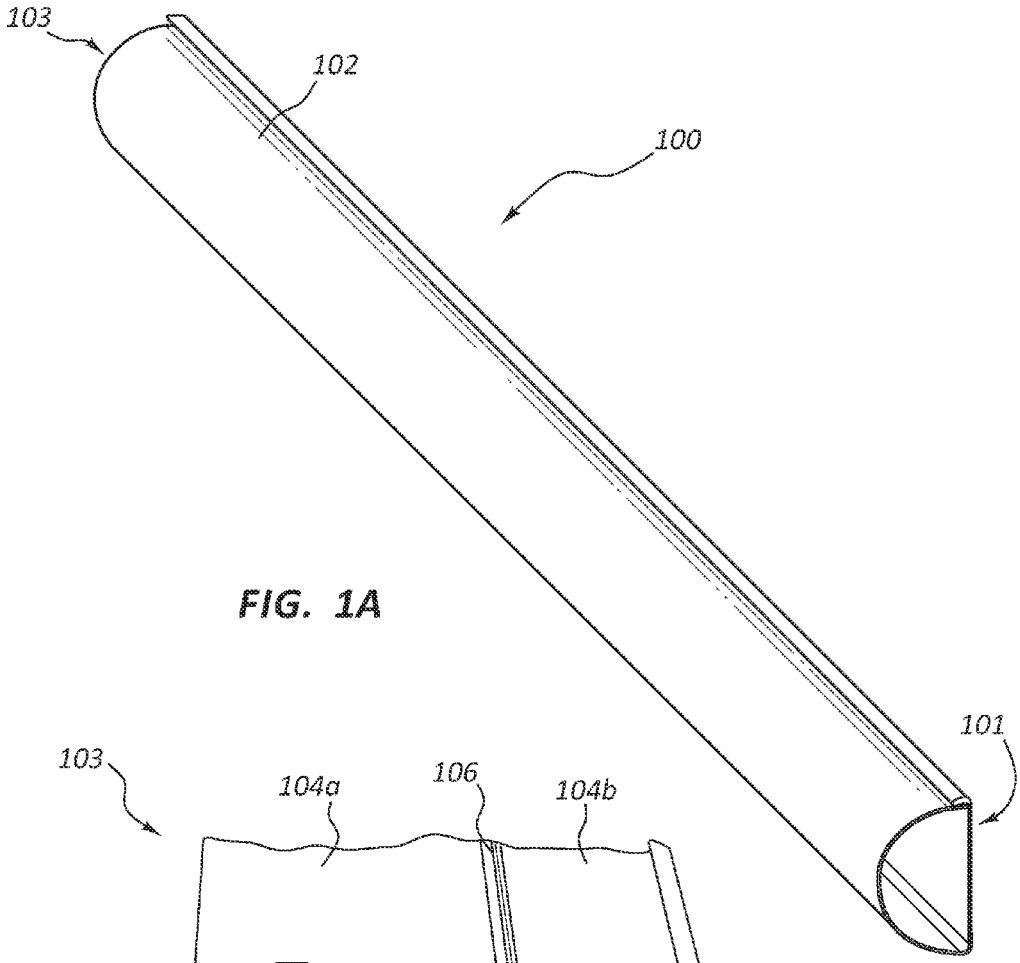
FIG. 1A is a perspective view of an exemplary support device for supporting a graphic display with the support device in an assembled, tube-shaped configuration.
Figure 1B:
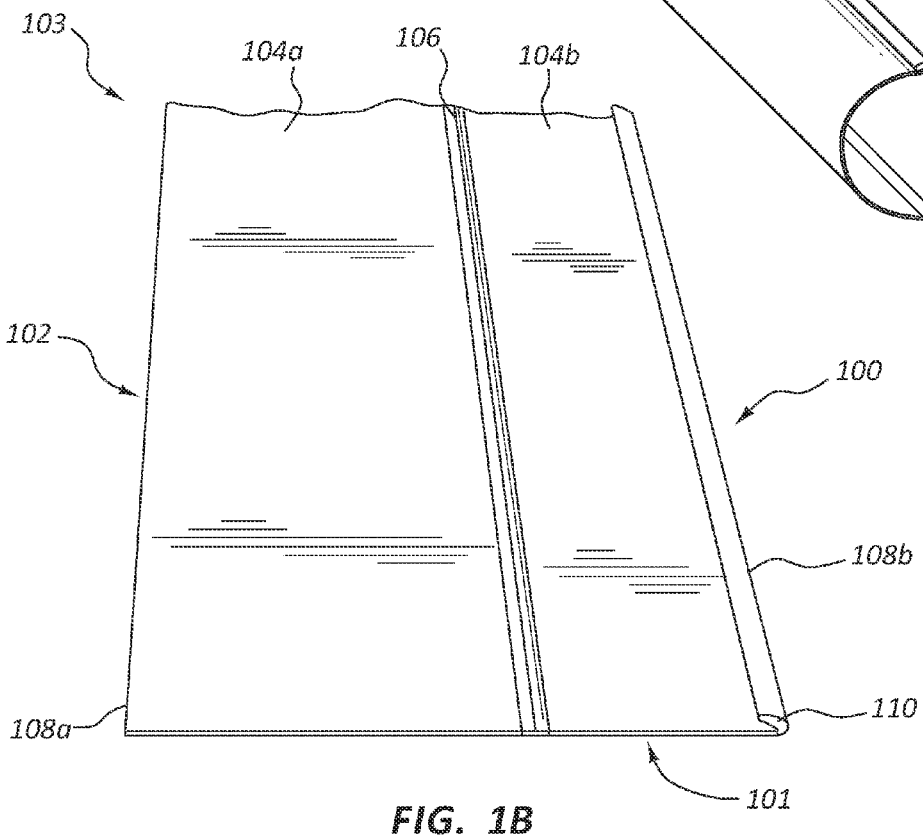
FIG. 1B is a perspective view of the support device of FIG. 1A in a disengaged and rollable configuration.
Figure 1C:
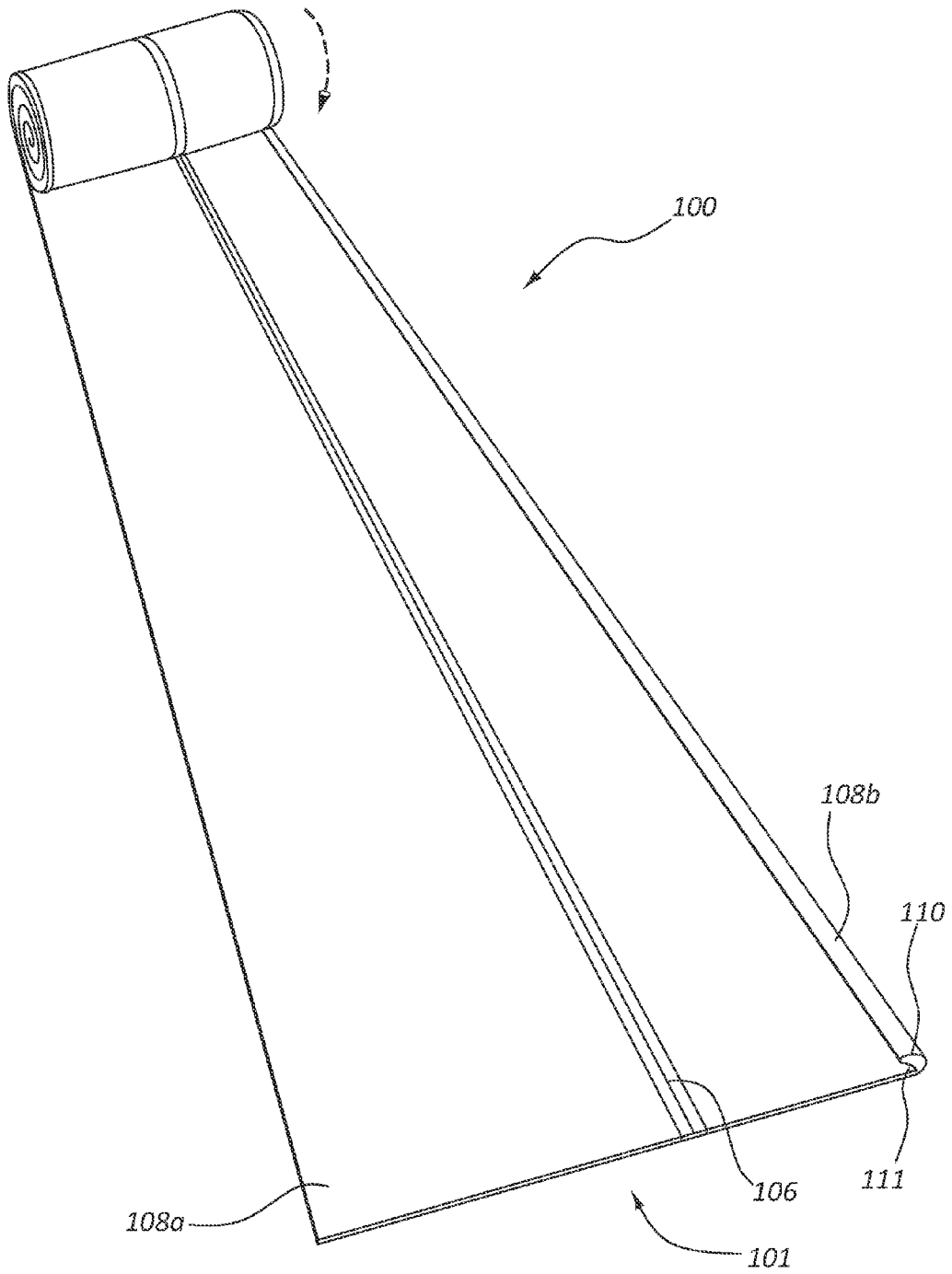
FIG. 1C is a perspective view of the support device of FIG. 2B having been partially rolled-up length wise.

FIGS. 1A and 1B shows perspective views of an exemplary support device 100 in an engaged, and disengaged configuration respectively. Support device 100 includes a body 102 extending a length between a first end 101 and a second end 103. Support device 100 further includes first and second side edges 108*a* and 108*b* extending along the length of elongate body 102. First and second side edges 108*a*, 108*b* comprise at least one recess or protrusion for selectively locking side edges 108*a*, 108*b* together to selectively orient elongate body 102 in an elongate tube-shaped configuration when first side edge 108*a* and second side edge 108*b* are selectively locked together, as shown in FIG. 1B. Thin-walled elongate body 102 is sufficiently flexible so that when first and second side edges 108*a*, 108*b* are disengaged, body 102 can be rolled along its length into a tube-shaped configuration for storage, as shown in FIG. 1C.

Support device 100 may include a bend line 106 (also referred to interchangeably herein as a crease) formed along its length between first and second side edges 108*a* and 108*b*, which may assist elongate body 102 in assuming a particular desired tube-shaped configuration upon selectively locking side edges 108*a*, 108*b*. For example, bend line 106 may result in a generally D-shaped elongate tube-shaped configuration as seen in FIG. 1A. Bend line 106 may define separate portions 104*a* and 104*b* of thin-walled, elongate body 102. Each portion 104*a* and 104*b* may include a corresponding side edge 108*a* and 108*b*, respectively. As side edges 108*a* and 108*b* are bent towards one another and engaged with one another, bend line 106 causes elongate body 102 to assume a substantially D-shaped configuration, in which portion 108*a* becomes curved while portion 108*b* remains substantially straight.

Bend-line 106 may comprise a pre-formed crease that forces the arched portion 104*a* of the generally D-shaped structure to intersect the generally straight leg (portion 104*b*) of the D at a desired location. When the graphic display system is not being used, the material properties of support device 100 are such that the support device 100 may be rolled-up, the elongate thin-walled body 102 rolling lengthwise over bend line 106. Alternatively, one may employ the tube-shaped support device 100 as a "core" about which the graphic display material may easily be rolled. In either case, the support device 100 advantageously provides support to the graphic display material without the need for any traditional frame or stands, which are not readily rolled-up with the graphic display (e.g., flexible, rollable paper board or similarly characterized plastic substrate sheet material).

Figure 2A:
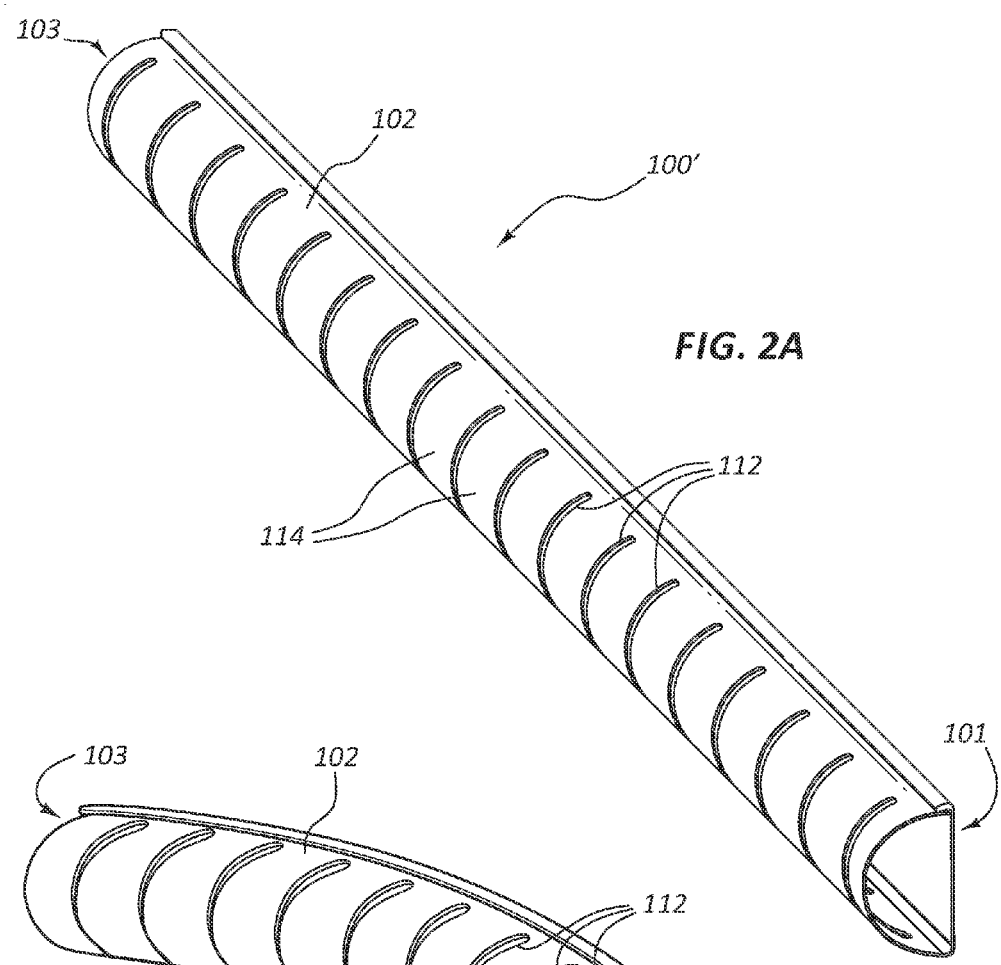
FIG. 2A is a perspective view of an exemplary support device for supporting a graphic display, the support device including a plurality of transverse recesses formed along its length.
Figure 2B:
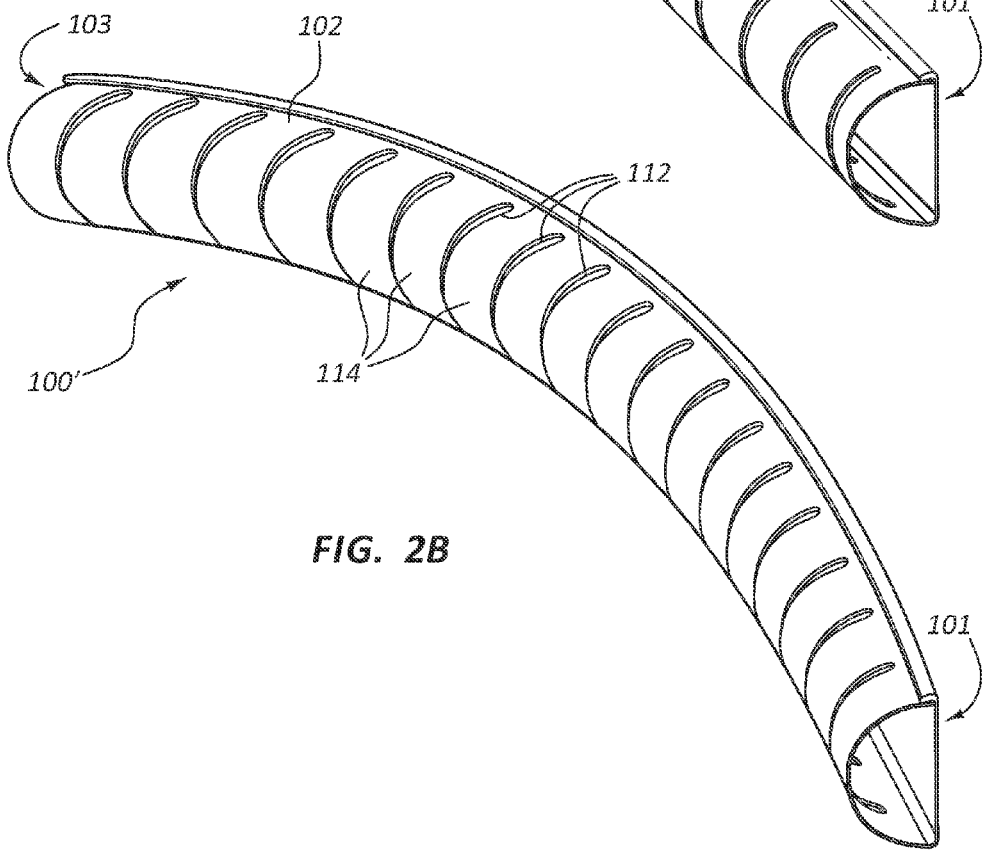
FIG. 2B is a perspective view of the support device of FIG. 2A in a curved configuration.
Figure 2C:
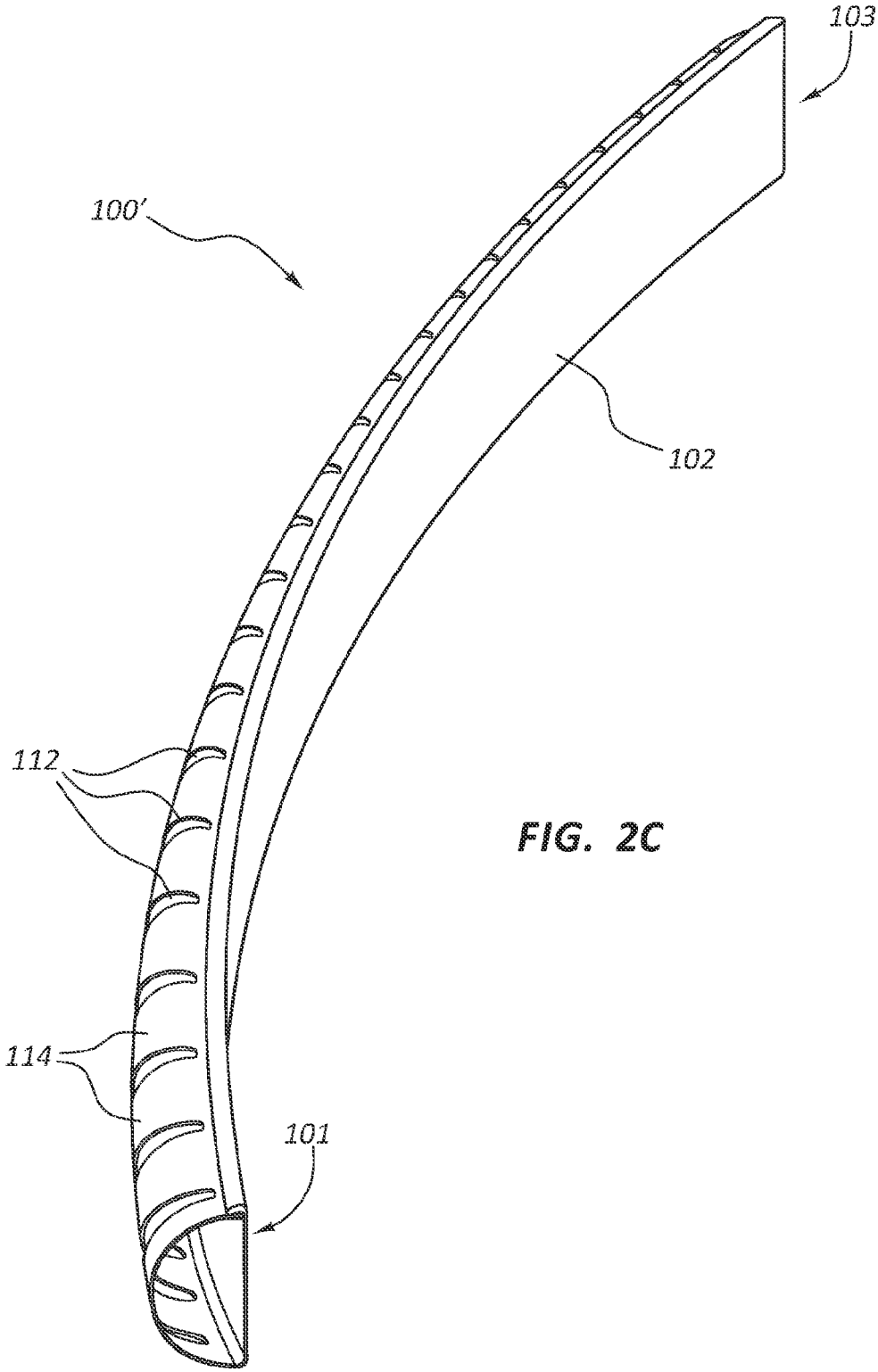
FIG. 2C is a perspective view of the support device of FIG. 2A in an oppositely curved configuration.
Figure 2D:
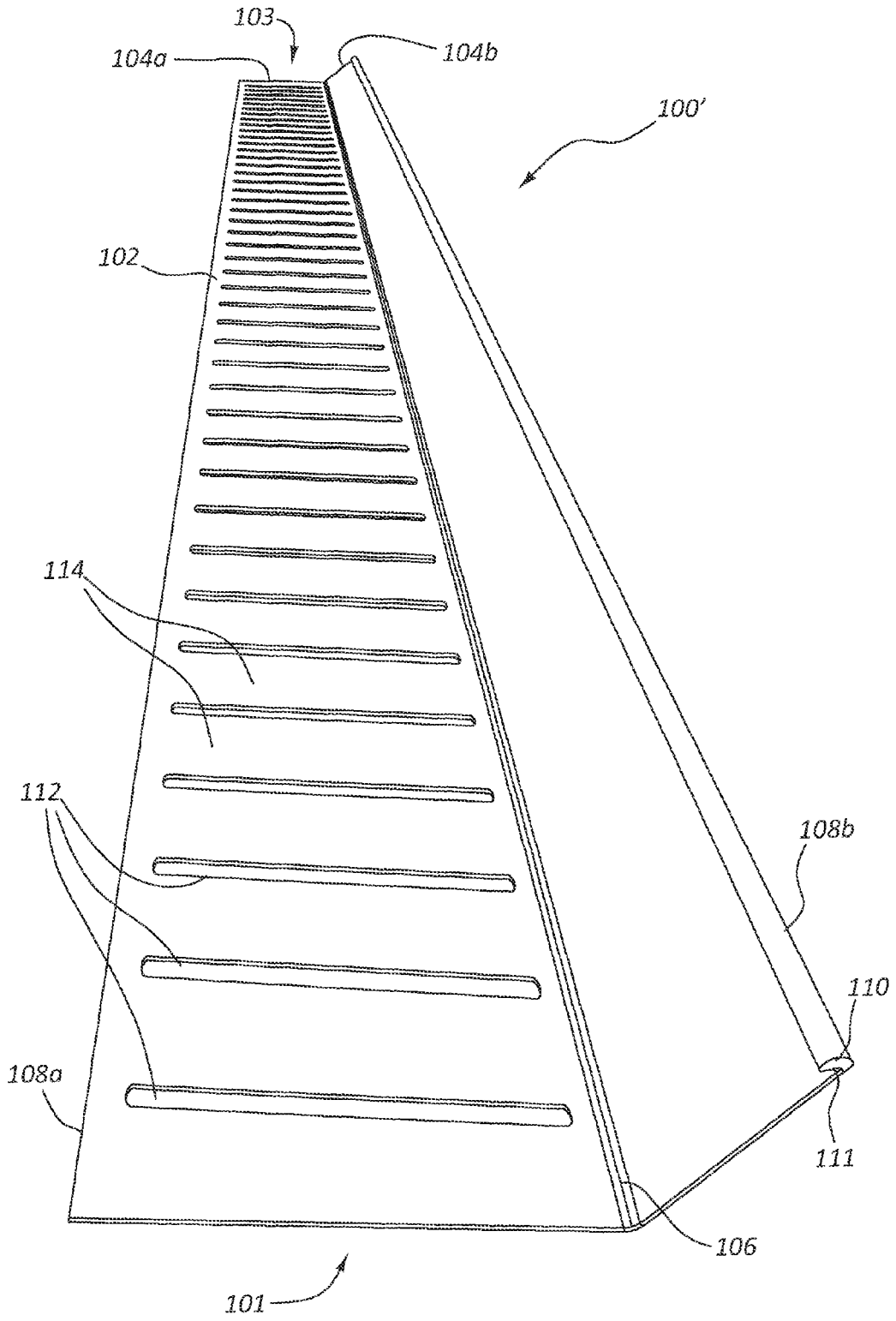
FIG. 2D is a perspective view of the support device of FIG. 2A in a disengaged and rollable configuration.
Figure 2E:
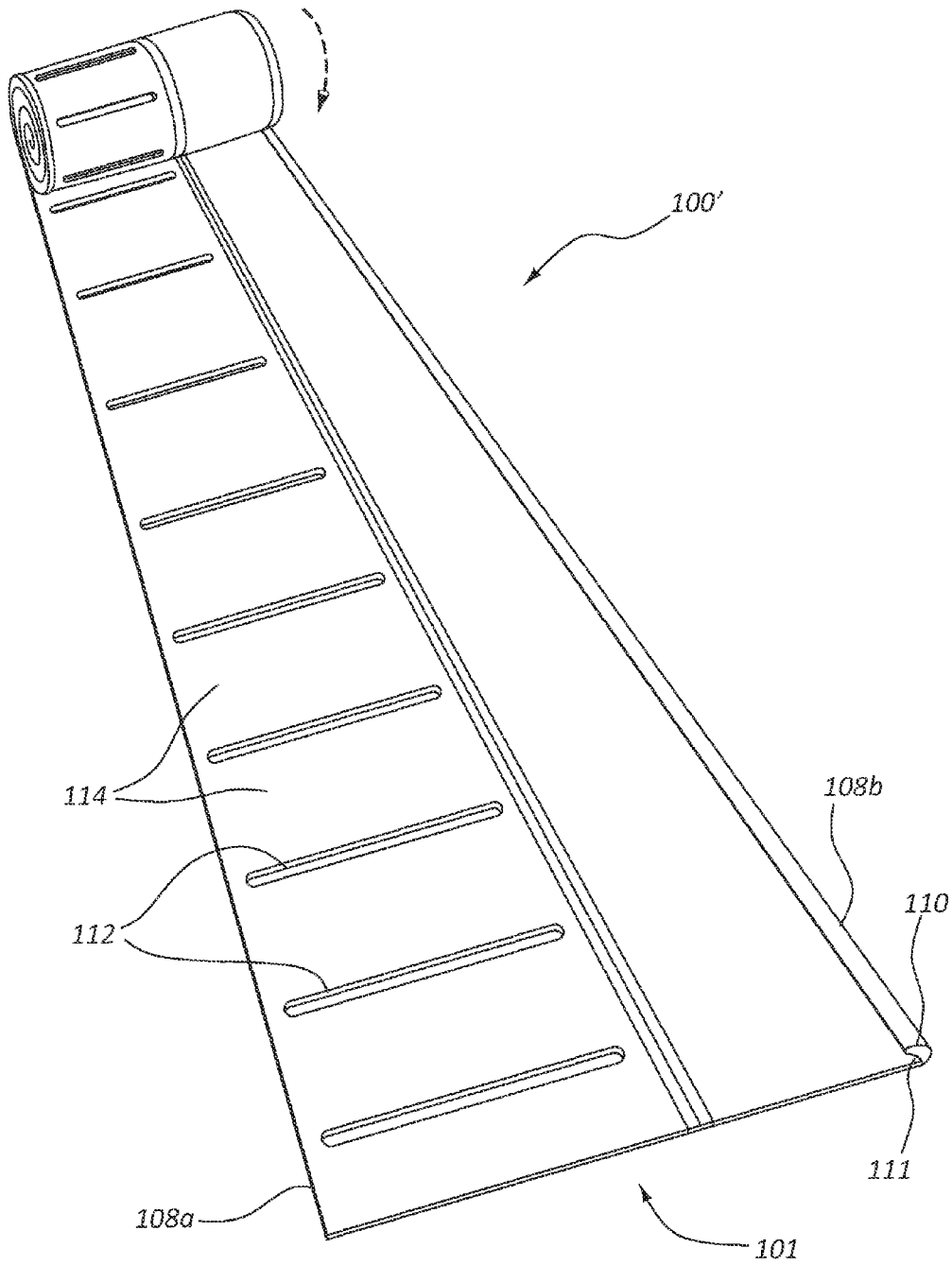
FIG. 2E is a perspective view of the support device of FIG. 2D after it has been partially rolled-up lengthwise.

FIGS. 2A-2C show perspective views of another exemplary support device 100' in an engaged, selectively locked configuration. FIG. 2B shows curvature in one direction, while FIG. 2C shows curvature in an opposite direction. FIG. 2D shows support device 100' in a disengaged configuration. Support device 100' is similar to support device 100 of FIGS. 1A-1C, but includes a plurality of transverse recesses 112 (also referred to interchangeably herein as slots) formed along its length to assist support device 100 in assuming a curved configuration (e.g., as seen in FIGS. 2B-2C).

Figure 9:
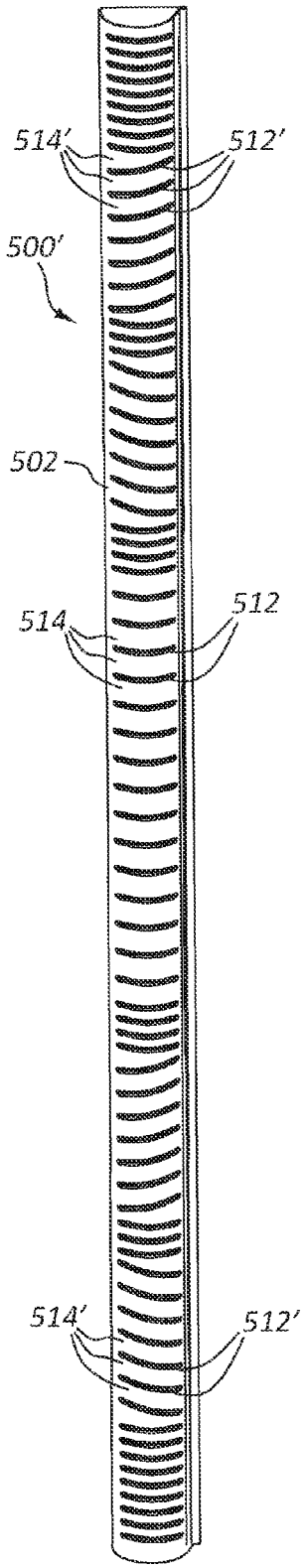
FIG. 9 is a perspective view of another exemplary support device similar to that shown in FIG. 2A, but in which at least some of the recesses are non-perpendicular relative to a longitudinal axis of the elongate body so as to cause the support device to have a desired axial twist.
Figure 10A:
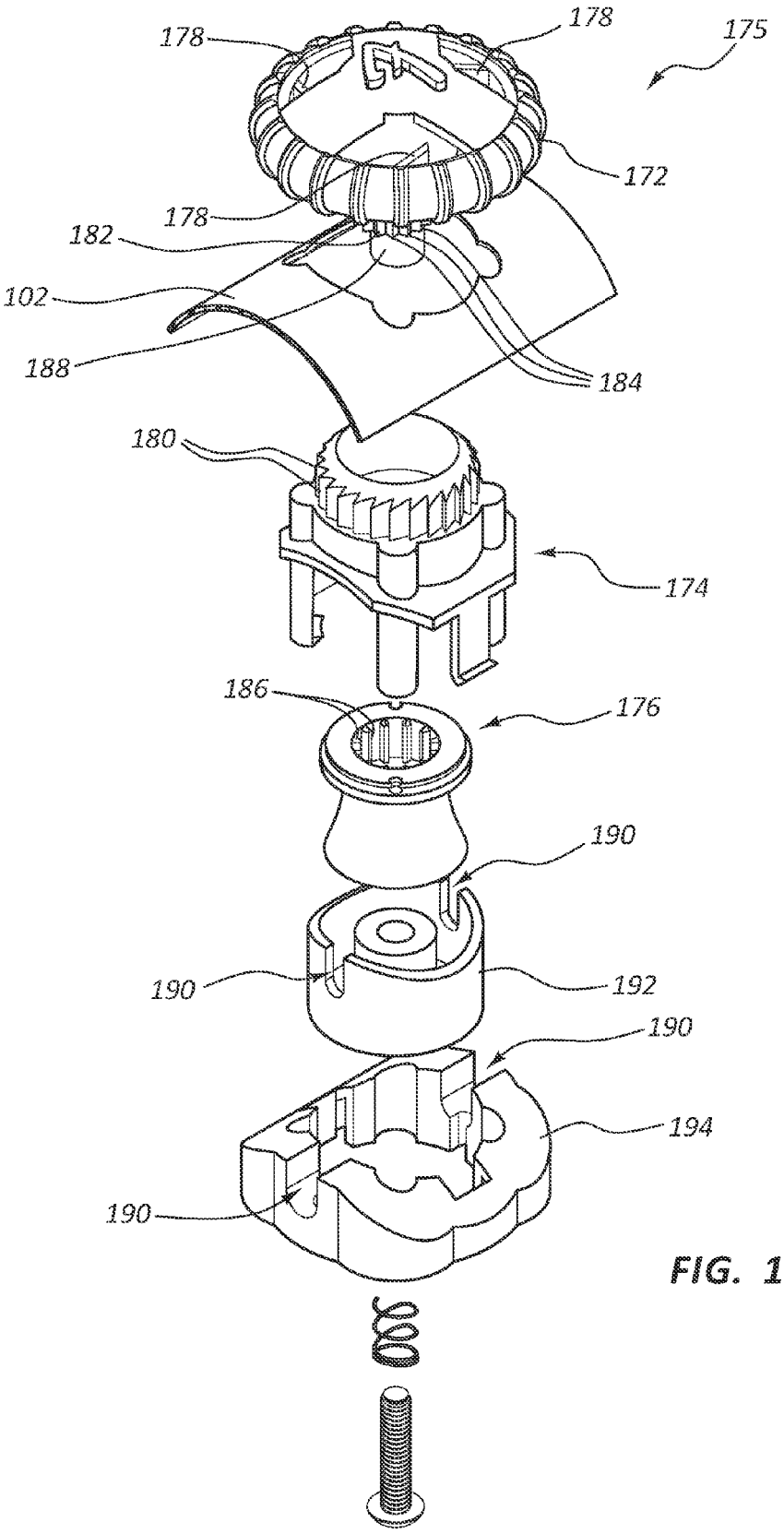
FIG. 10A is an exploded view of an exemplary ratchet device.
Figure 10B:
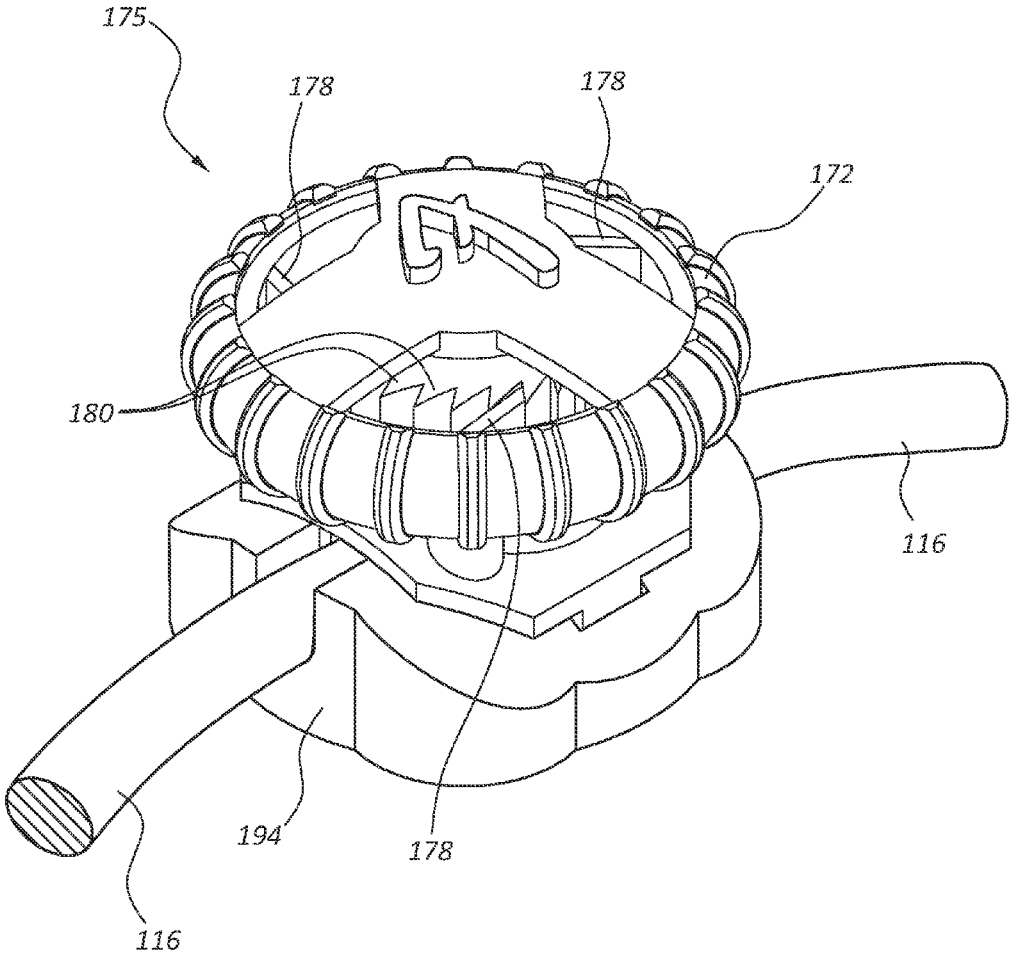
FIG. 10B is a perspective view of the ratchet device of FIG. 10A.
Figure 10C:
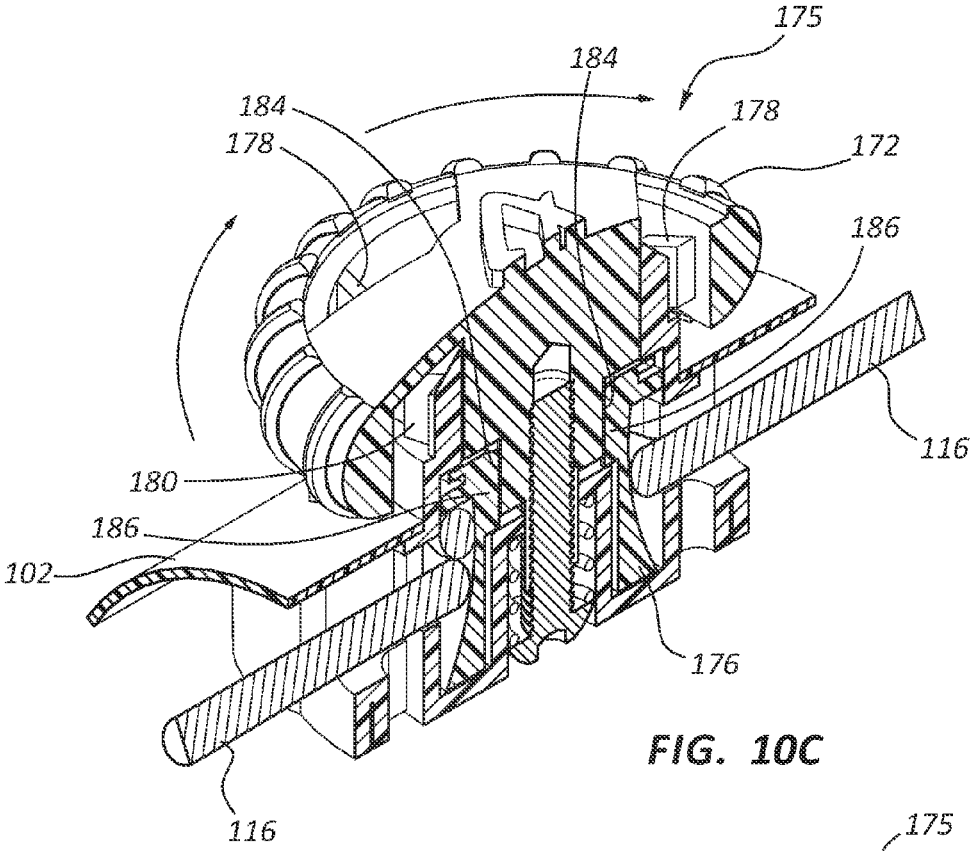
FIG. 10C is a cross-sectional view through the ratchet device of FIG. 10A.
Figure 10D:
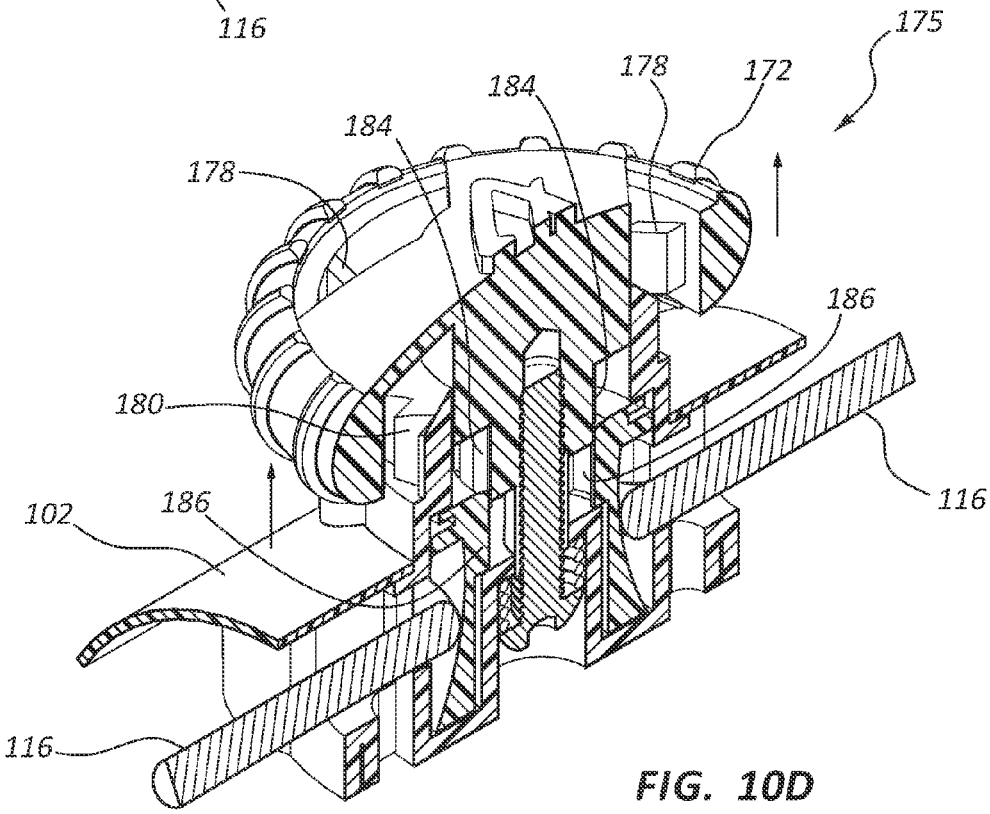
FIG. 10D is a cross-sectional view similar to that of FIG. 10C, but in which the handle has been pulled up, disengaging the teeth of the spool from the teeth of the central shaft of the handle.

In the configuration shown in FIG. 2D, recesses 112 are shown as being oriented substantially perpendicularly relative to a longitudinal axis of body 102 of support device 100'. Recesses or slots 112 are shown as being substantially equally spaced along the length of first portion 104*a* so that sections 114 defined between recesses 112 have substantially equal length. It will be appreciated that in other embodiments, recesses 112 may be differently configured. For example, at least some of recesses 112 may be oriented at a non-perpendicular angle relative to a longitudinal axis of the elongate body, as seen in FIG. 9. Such orientation may assist support device 100' in exhibiting an axial twist, which may be desirable in some graphic display systems. In another embodiment, recesses 112 may not be substantially equally spaced along the length of first portion 104*a*, as seen in FIGS. 7B-7C in order to provide a varying radii of curvature along the length of the elongate body.

In one embodiment, each recess or slot 112 may extend along nearly the entire length of first portion 104*a*, from near bend line 106 (where the straight leg of the D meets the curved face) to the opposite edge 108*a* of the curved face. In one embodiment, recesses or slots 112 may end just prior to the edge 108*a*, so that the entire length of edge 108*a* of support device 100 can be interlocked into the opposite interlocking edge 108*b*.

Of course, one may extend recesses or slots 112 through the entire length of first portion 104*a*, so as to form a plurality of fingers which may be independently locked in place. The inclusion of the plurality of recesses or slots 112 allows the support device to more easily assume a smooth curved configuration (without kinking) as the ends of the support device are brought towards one another. Of course, where no curvature is desired in a given support structure, no recesses or slots 112 may be included so that portion 104*a* is continuous and substantially uninterrupted, as shown in FIGS. 1A-1B.

Side edges 108*a* and 108*b* of support devices 100 and 100' include at least one recess or protrusion for selectively locking the side edges together. For example, second side edge 108*b* may include a lateral protrusion 110 forming a recess 111 configured to receive a corresponding portion of first side edge 108*a* when the side edges 108*a*, 108*b* are selectively locked together. The edges are locked together absent application of a disengaging force.

Figure 3A:
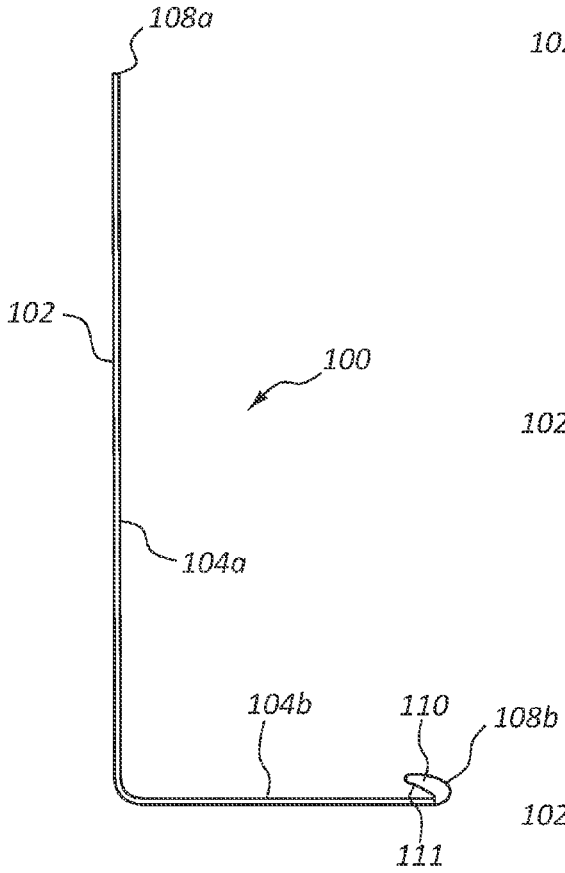
FIG. 3A is an end view showing an exemplary interlocking mechanism disposed at opposed first and second side edges of a support device for selectively locking the first and second side edges together.
Figure 3B:
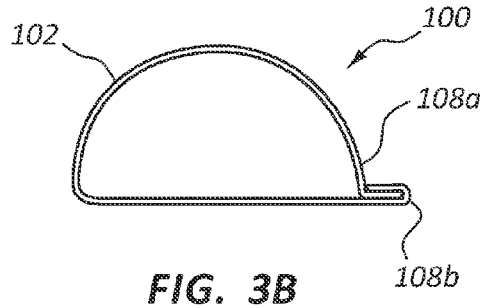
FIG. 3B is an end view showing another interlocking mechanism.
Figure 3C:
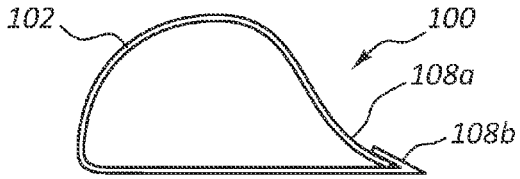
FIG. 3C is an end view showing another interlocking mechanism.
Figure 3D:
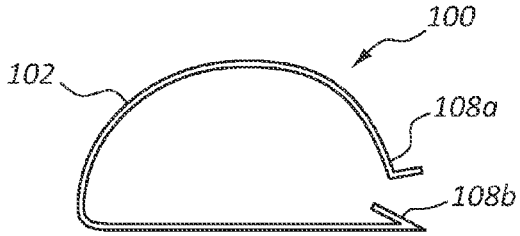
FIG. 3D is an end view showing another interlocking mechanism.
Figure 3E:
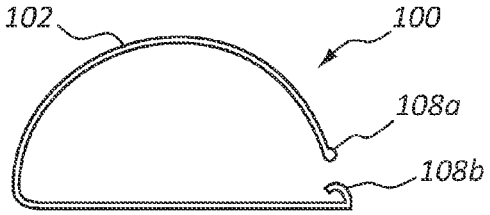
FIG. 3E is an end view showing another interlocking mechanism.

FIG. 3A shows an end view of the elongate thin-walled body 102, showing these locking mechanisms. Other recess and protrusion locking mechanisms are also possible. FIG. 3B shows one edge 108*b* including a U-shaped hook, FIG. 3C shows a V-shaped hook at edge 108*b* creating an acute angle with oppositely disposed edge 108*a*. FIG. 3D shows edge 108*b* including a curved hook. Opposite edge 108*a* may include no particular hook at its end, as shown in FIG. 3C, it may include a lateral extension (FIG. 3B or 3D), or a ball, a bulbous end, or other enlarged end (FIG. 3E). In any case, a recess or protrusion provided on at least one edge selectively interlocks with the other edge. It will be readily apparent that any of various selective locking mechanisms including at least one recess or protrusion may be employed.

Figure 3F:
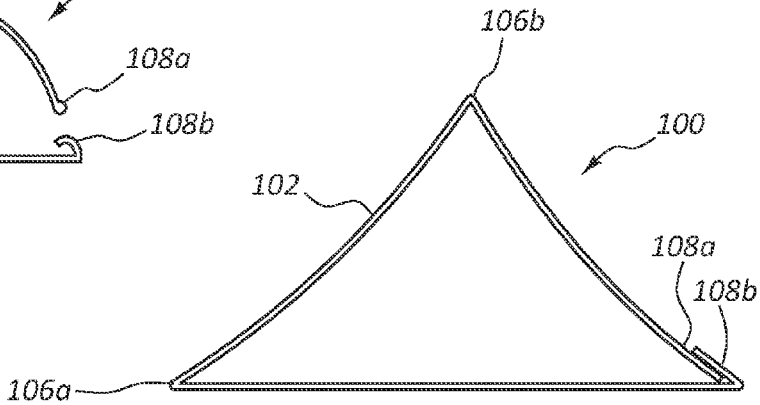
FIG. 3F is an end view showing another interlocking mechanism for a tube-shaped support device having a triangular transverse cross-section.

FIGS. 1A-1B and 2A-2C show how the spring force of the curved portion 104*a* of body 102 holds curved portion 104*a* to result in a substantially D-shaped structure when edge 108*a* is selectively locked with edge 108*b*. In other words, first portion 104*a* may curve to form the curved face of a substantially D-shaped structure while second portion 104*b* may form the substantially straight leg of the substantially D-shaped structure. FIG. 3F shows an alternative tube-shaped configuration having a triangular shape including interlocking structure similar to that of FIG. 3C. It will be readily apparent that various tube-shaped configurations of various transverse cross-sectional shapes are possible.

The configuration of FIG. 3F may include two bend lines (106*a* and 106*b*) defining three portions that may result in a triangular tube-shaped support structure. One or more sides of such a triangle may be concavely curved. In another embodiment, convexly curved triangular sides, or a combination of curvatures may be possible. As seen in FIG. 3F, the engaging edge 108*a* may not include any particular protrusion or recess structure, but simply become trapped by the angled recess (e.g., acutely angled) at the opposite edge 108*b*. The angle of such an angled recess such as that shown in FIG. 3F or FIG. 3C may take various configurations, so long as it is sufficient to hold the opposite edge in place. In another triangular configuration, the various sides of the triangle may be separate pieces (without bend lines) that become interlocked together.

As seen, first portion 104*a* may have a greater width than second portion 104*b*. First portion may have a width that is about 125% to about 300%, or 150% to about 250% that of second portion 104*b*. For example, first portion 104*a* may have a width that is about twice that of second portion 104*b*. In combination with bend line 106, such a configuration allows first portion 104*a* to bend while second portion 104*b* remains substantially planar, resulting in a substantially D-shaped configuration as seen in FIGS. 1A and 2A-2C. Of course, other configurations are possible. Where no bend line is provided, the resulting tube-shaped support structure may be substantially cylindrical in shape.

The thin-walled elongate body 102 of support device 100 or 100' may be in the form of a sheet (e.g., as shown in FIGS. 1B and 2D) that may be attachable to the graphic display. Attachment may be achieved using clips, adhesive, magnets, or any other suitable attachment mechanism. Sheet body 102 may have any suitable thickness. The thickness and material composition of body 102 at least in part contributes to the degree of flexibility or rigidity provided by body 102 and its ability to support the graphic display when in an assembled structure (e.g., that allows the graphic display system to stand upright or otherwise support itself). In some embodiments, the assembled support device structure may not necessarily stand "vertically", but may be oriented horizontally, or may comprise a plurality of such support device components that are attached together, forming an overall supporting structure. Various examples including a plurality of support device components to support a graphic display are shown in the Figures. It will be apparent that various other configurations are also possible.

Any suitable flexible, rollable material may be employed for support device 100. Plastics are one preferred class of materials. In one embodiment, the material comprises polybutylene terephthalate (PBT). Other plastic materials that may be suitable include, but are not limited to various polyolefins. Specific examples of plastics that may be suitable include PBT, polyethylene, polypropylene, polyethylene terephthalate (PET), polystyrene, and combinations thereof. The desired thickness of the material may of course depend on the particular properties of the material selected. For example, relatively more flexible materials may be employed with a relatively greater thickness as compared to less flexible materials. By way of example, a typical thickness may be between about 0.001 inch and about 0.1 inch, between about 0.005 inch and about 0.04 inch, or between about 0.01 inch and about 0.03 inch (e.g., about 0.02 inch).

In one embodiment, thin-walled elongate body 102 may comprise different materials at different locations of body 102. For example, the material adjacent bend line 106, edge 108*a*, edge 108*b*, or any combination thereof may comprise a relatively softer (lower durometer), more flexible material than the other portions of body 102. In one example, bend line 106 and edge 108*b*, which includes lateral protrusion 110 and recess 111 is formed of a softer, lower durometer, more flexible material than the remainder of thin-walled elongate body 102 (including edge 108*a*). Such a dual material thin-walled elongate body 102 may be formed through dual extrusion techniques. For example, where a given level of flexibility is desired, this may be achieved through varying the durometer of the material or the thickness of the material. Thus, a softer, lower durometer material may provide a given level of flexibility while allowing a greater thickness than a harder, higher durometer material.

In one embodiment, the locking mechanism that allows the elongate thin-walled body to "hook" or otherwise lock into an assembled configuration may comprise a separate piece that is attached to elongate thin-walled body 102. For example, a metal, plastic, or elastomeric edge member may be attached at one edge of body 102 for interlocking with the opposite edge.

According to one embodiment, the support devices may be formed of a thin-walled plastic sheet. Such a plastic sheet may be sold or provided as a roll of stock material. A desired length of the plastic sheet material may be cut off such a roll to form a desired support device. Recesses or slots 112 may be preformed (e.g., through die cutting) into such a sheet material, if desired. Any bend lines (e.g., bend line 106) may be preformed into the plastic sheet stock material. In addition, any locking protrusions or recesses for engaging opposed side edges of the support device may also be preformed into the plastic sheet stock material (e.g., the sheet may be extruded with such features present). Such embodiments allow great flexibility to the end user in easily fabricating support devices for any desired graphic display system, no matter the dimensions, shape, or size.

For example, the flat sheet of plastic material may be extruded with a crease where a bend line is to be, and the entire roll of flat sheet plastic material may include edges extruded with the desired locking protrusions and/or recesses. In one embodiment, only one side edge (e.g., edge 108*b*) includes a protrusion/recess structure, while the other end is "straight" and simply engages within the opposite end when bent to shape. Various exemplary configurations are shown in FIGS. 3A-3F. The plastic material is advantageously thin-walled and sufficiently flexible to allow the desired bending to a desired interlocked shape (e.g., into a generally D-shaped tube), but is also sufficiently rigid to be self supporting once interlocked for use. Where a curved support member is employed along the base of a graphic display system, this provides excellent self-supporting ability to the graphic display system so as to resist any tendency to otherwise tip over.

The dimensions of the graphic display systems and the support members used to provide support to the graphic display material may be as desired. For example, one D-shaped support member embodiment may be formed of a sheet of plastic about 4-12 inches wide (e.g., about 8 inches wide). A bend line or crease may be formed at a location corresponding to about one third of the width (e.g., at about 2.75 inches of an 8 inch width), so that the remaining two thirds (e.g., 5.25 inches of an 8 inch width) portion can be bent over to form the curved face of the D. Plastic sheeting of the same width may be used for both generally vertically oriented support devices and generally horizontally oriented support devices. It will be readily understood that support devices may also be oriented at any other desired angle or orientation (e.g., diagonal, curved, etc.).

Figure 4A:
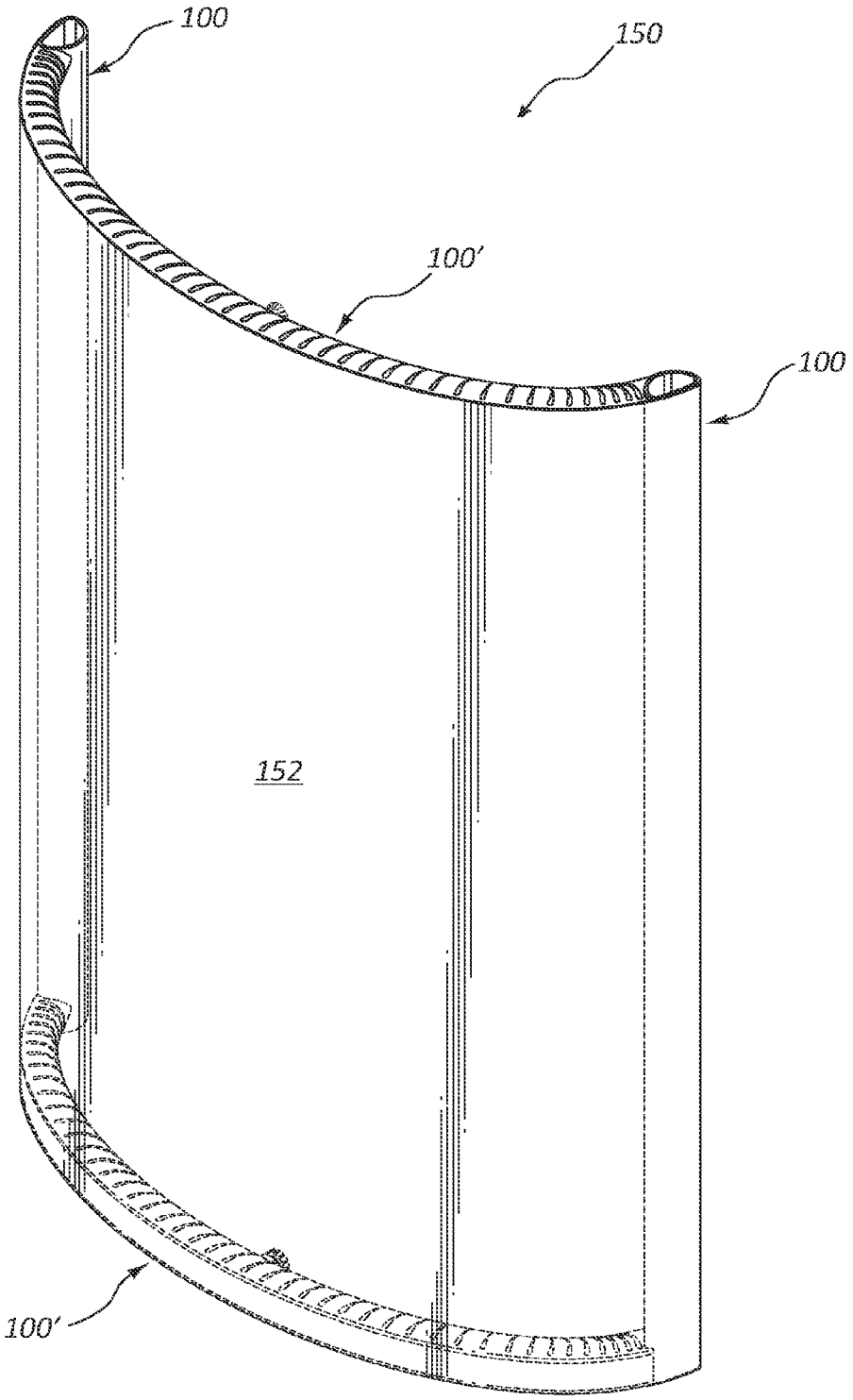
FIG. 4A is a front perspective view of an exemplary graphic display system including graphic display material supported by one or more support devices of the present invention.
Figure 4B:
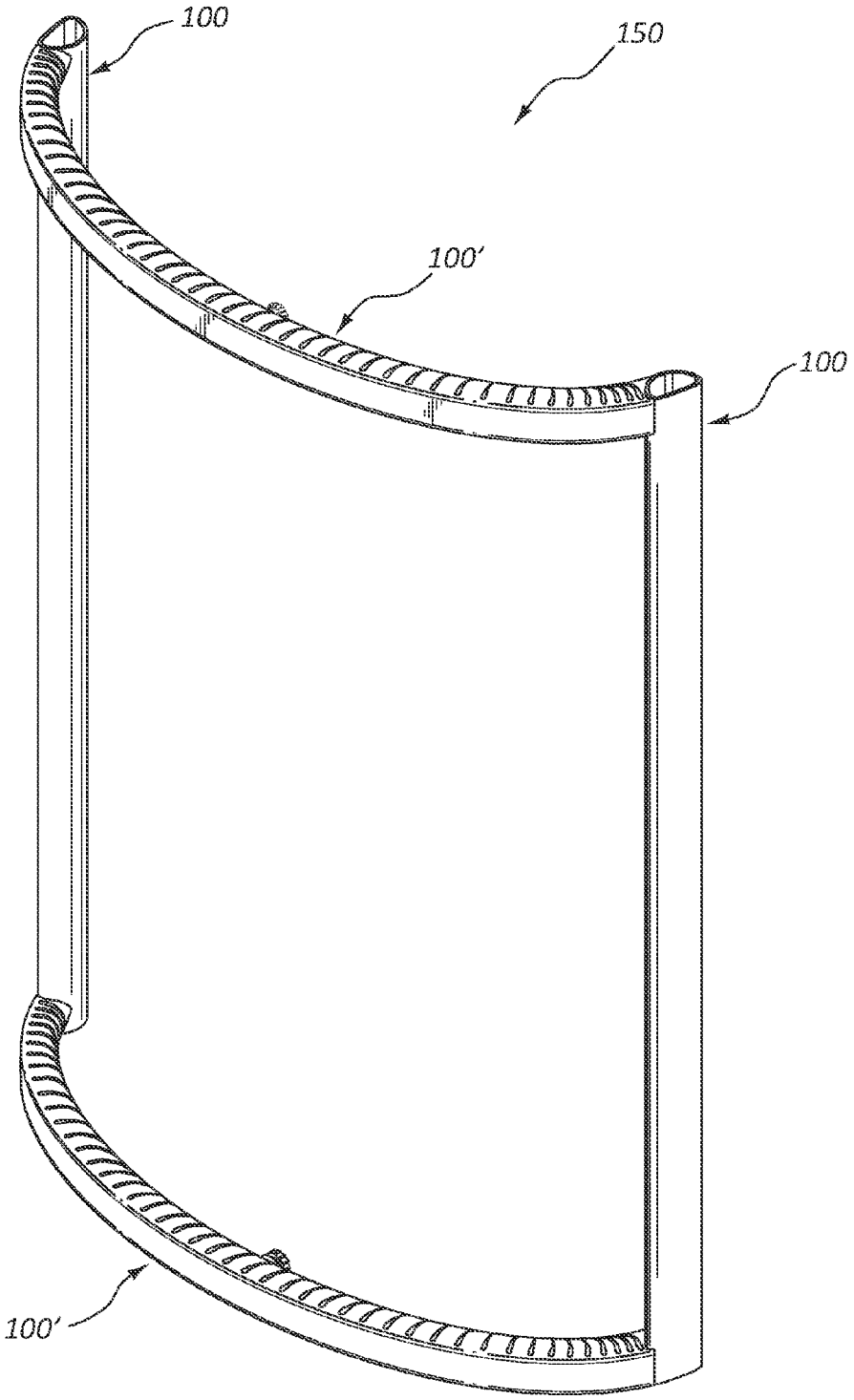
FIG. 4B is a front perspective view of the graphic display system of FIG. 4A, prior to attachment of the graphic display material.
Figure 4C:
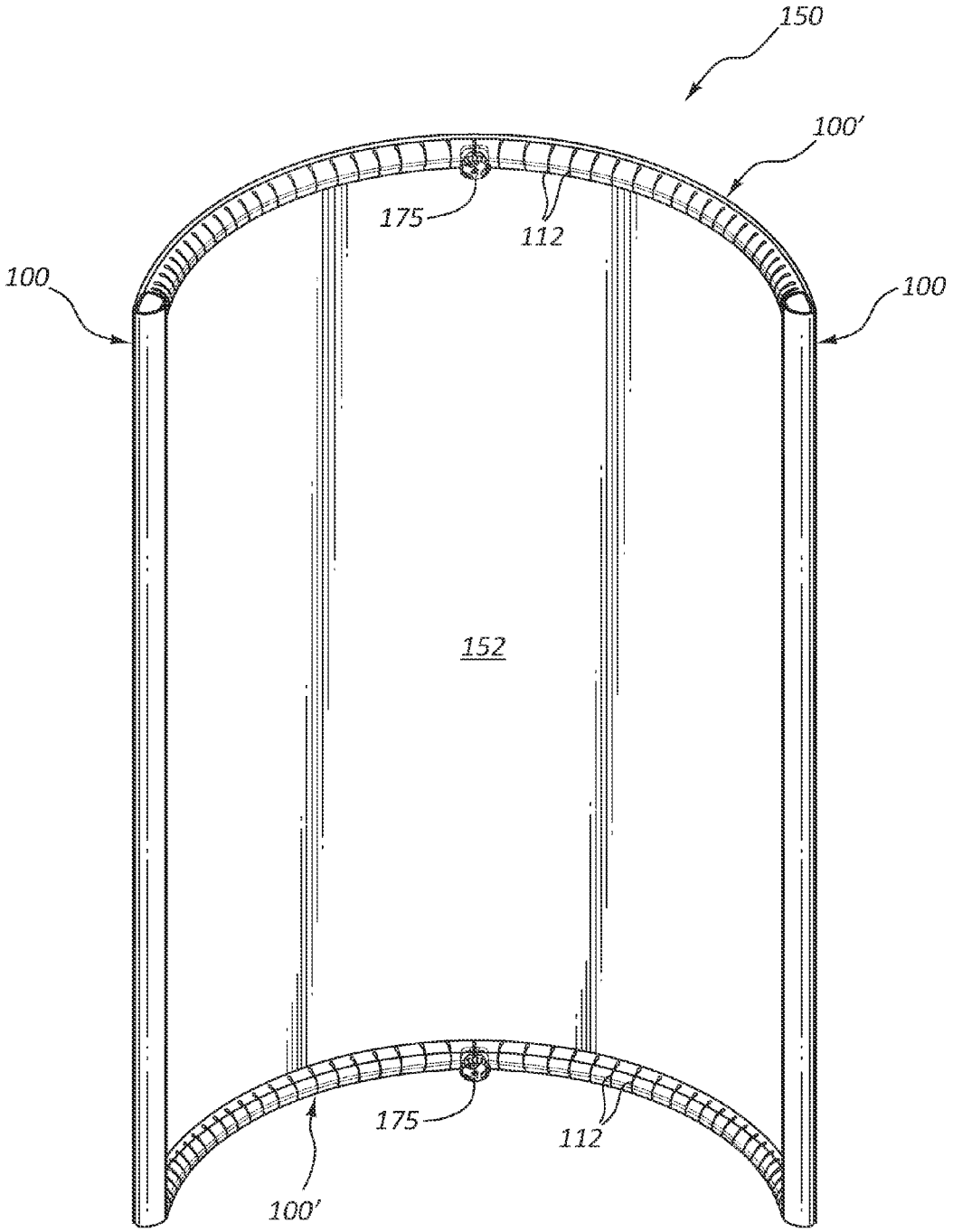
FIG. 4C is a rear perspective view of the graphic display system of FIG. 4A.

FIGS. 4A-4C show various perspective views of an exemplary graphic display system 150 that is supported by a plurality of support members such as those shown in FIGS. 1A-2B. Graphic display system 150 includes flexible thin-walled graphic display sheet 152 that acts as a substrate onto which a printed or otherwise applied graphic display (e.g., advertising) may be disposed. Graphic display sheet 152 may comprise any suitable flexible substrate. Examples include, but are not limited to paper, paper board, plastic substrates, or combinations thereof.

Graphic display sheet 152 is supported by one or more support devices. Illustrated graphic display system 150 includes two substantially horizontally disposed support devices 100' (e.g., one at or near a top portion of graphic display sheet 152 and one at or near a bottom portion of graphic display sheet 152) and two substantially vertically disposed support devices 100.

As perhaps best seen in FIG. 4C, substantially horizontally disposed support devices 100' are oriented in a curved configuration, so as to define a curved profile to which graphic display sheet 152 conforms. Each of support devices 100 include a plurality of recesses or slots 112 formed in the first portion (i.e., that portion that forms the curved face of the general D-shape) so as to accommodate such a curvature. Substantially vertically disposed support devices 100 are oriented in a substantially linear configuration, supporting the side edges of graphic display sheet 152. As no curvature is needed within support devices 100, no transverse recesses are present within the curved face of support devices 100 so that the thin-walled elongate body from which devices 100 are formed may be substantially continuous and uninterrupted.

Each of support devices 100 and 100' may be formed of flexible sheet material so that the tube-shaped configuration of each support device can be disengaged, broken down and rolled along its length (see FIGS. 1C and 2E) with graphic display sheet 152 for transport or storage. The support devices may be rolled with the graphic display sheet 152 while sheet 152 remains attached to one or more of the support devices. Alternatively, sheet 152 may be detached from one or more of the support devices.

The rolled-up graphic display system may be contained within a storage tube (e.g., an elongate rectangular or cylindrical box) before and after use. When it is desired to set up the display system, the rolled-up system may be removed from the storage tube and unrolled. The side edges of any support members may be engaged with one another to form the desired tube-shaped configuration, and the graphic display sheet may be supported by the assembled support devices. When breaking down the system, the graphic sheet may or may not remain attached to the support devices as the edges of the support devices are disengaged and the system is rolled-up. Once rolled-up, the system may be placed within a storage tube.

In one embodiment, an elongate tensioning member 116 such as an elastic band, a rope, cord, string, or other elongate tensioning member may be coupled to each end of any of support devices 100'. Such a configuration may be particularly beneficial where the support device is to be oriented in a curved configuration, such as support devices 100' of FIG. 4C. FIG. 4E shows a cut-away view showing tensioning member 116 threaded through tube-shaped support member 100'. Elongate tensioning member 116 is coupled to the ends of support device 100', and can then be tensioned to pull support device 100' into the desired curved configuration. In one embodiment, the tensioning member 116 may be run through the interior of the support device, and the tensioning member 116 may include a hook 118 at each end for engaging the ends of support device 100' so as to pull it to a desired curvature.

If desired, a cord may be attached to one or both hooks 118 on either end of tensioning member 116 to aid in pulling tensioning member 116 through support device 100 where one of hooks 118 is already engaged with an end of support device 100. In another embodiment, a hole may be formed through body 102 near each end, and tensioning member may be threaded therethrough. A knot or similar enlarged structure at the end of tensioning member 116 may prevent detachment of tensioning member 116 from each end of body 102.

In one embodiment, elongate tensioning member 116 may include one or more slot engagement members spaced apart along the length of the elongate tensioning member for insertion into recesses 112, if desired. Such slot engagement members may be spaced along elongate tensioning member at intervals corresponding to the spacing of corresponding recesses 112. Such slot engagement members may engage recesses 112 when curved in a recess opening configuration, as shown in FIG. 2C, or a recess closing configuration, as shown in FIG. 2B.

Ratchet device 175 may be provided to enable a user to increase or release the tension applied to support device 100 by elongate tensioning member 116. Ratchet device 175 may be of any suitable configuration capable of ratcheting or tensioning elongate tensioning member 116. One suitable configuration is shown and described in conjunction with FIGS. 10A-10D. Ratchet device 175 may allow release of tension within elongate tensioning member 116 by pulling on the handle of ratchet device 175. Tension may be increased by rotating the handle of device 175. Other configurations are of course also possible. For example, any of the configurations described in U.S. Pat. No. 5,934,599, 6,209,953, 6,289,558, 7,591,050, 7,950,112, 7,992,261, 7,954,204, or 8,091,182, to Boa Technology, Inc. may alternatively be employed. Each of the above U.S. Patents is herein incorporated by reference in its entirety.

Figure 4D:
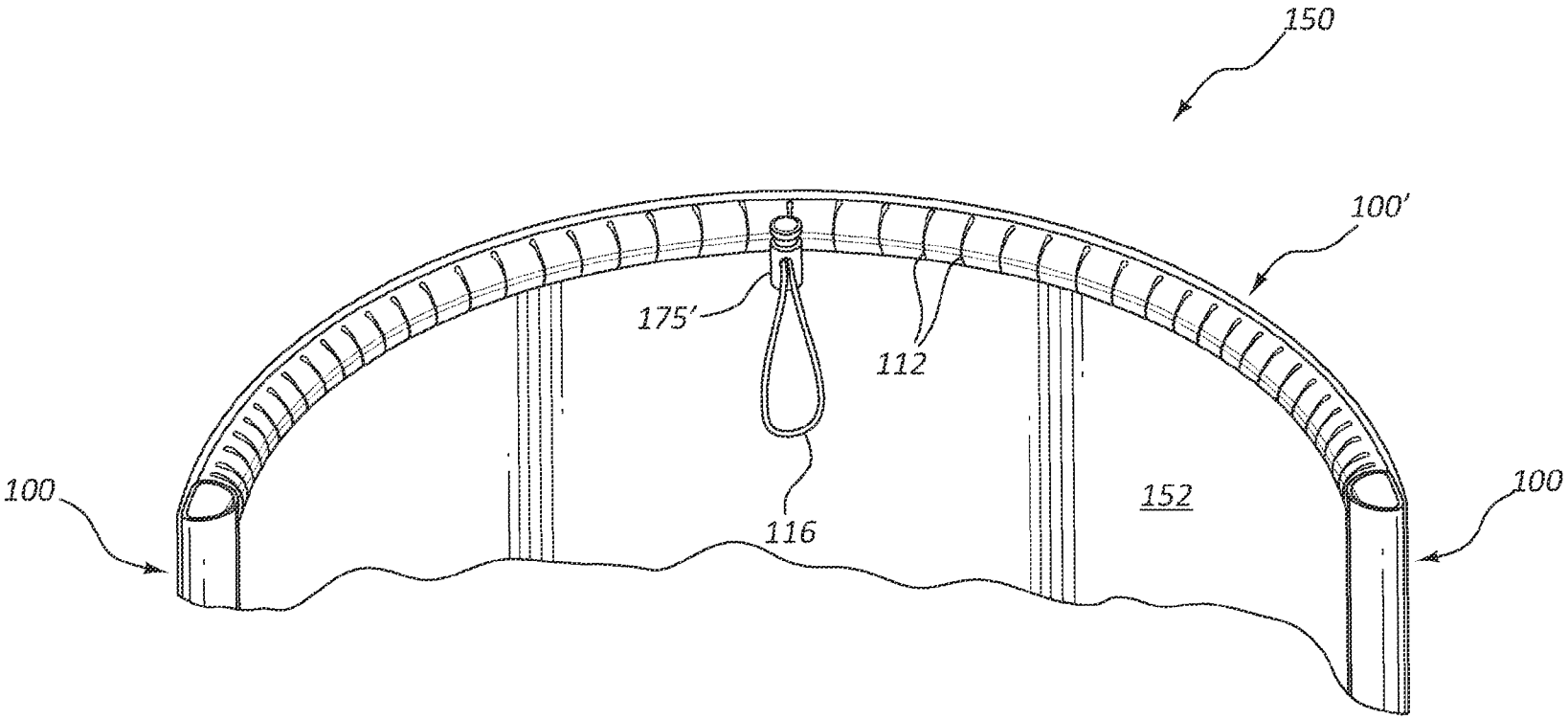
FIG. 4D is a perspective view of an alternative ratchet device for applying tension to an elongate tensioning member.
Figure 4E:
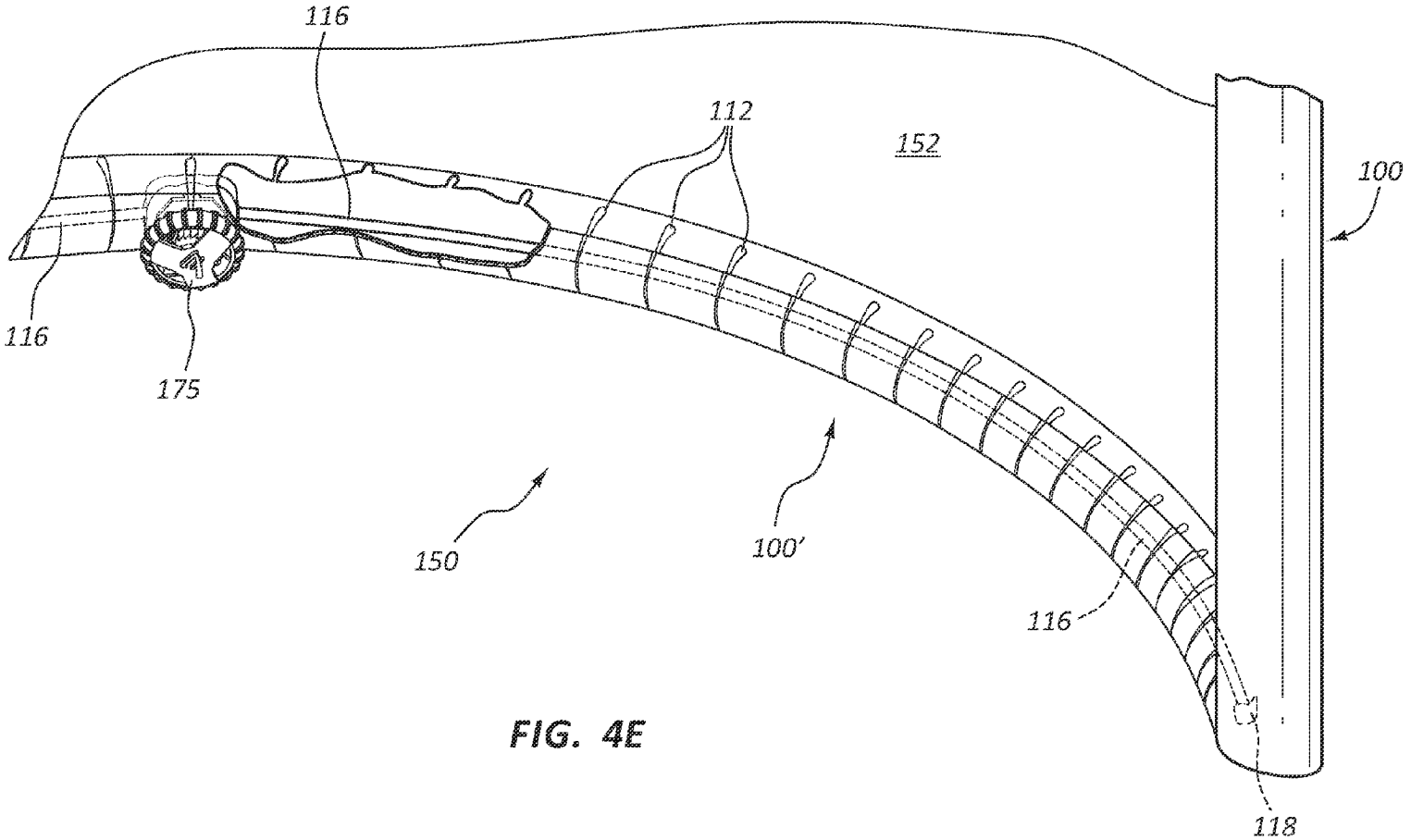
FIG. 4E is a cut-away view into one of the curved support devices of FIG. 4C, showing an elongate tensioning member attached to the support device for maintaining the support device in a desired curved orientation.

Another embodiment is shown in FIG. 4D in which tension may be applied to elongate tensioning member 116 through a slidable drawstring push button type tensioning member 175'. It will be readily apparent that various devices may be employed for maintaining a desired tension on elongate tensioning member 116 to maintain support device 100' in a desired curved configuration. Such tensioning or ratcheting members are broadly within the scope of the term ratchet member, as used herein.

Figure 5:
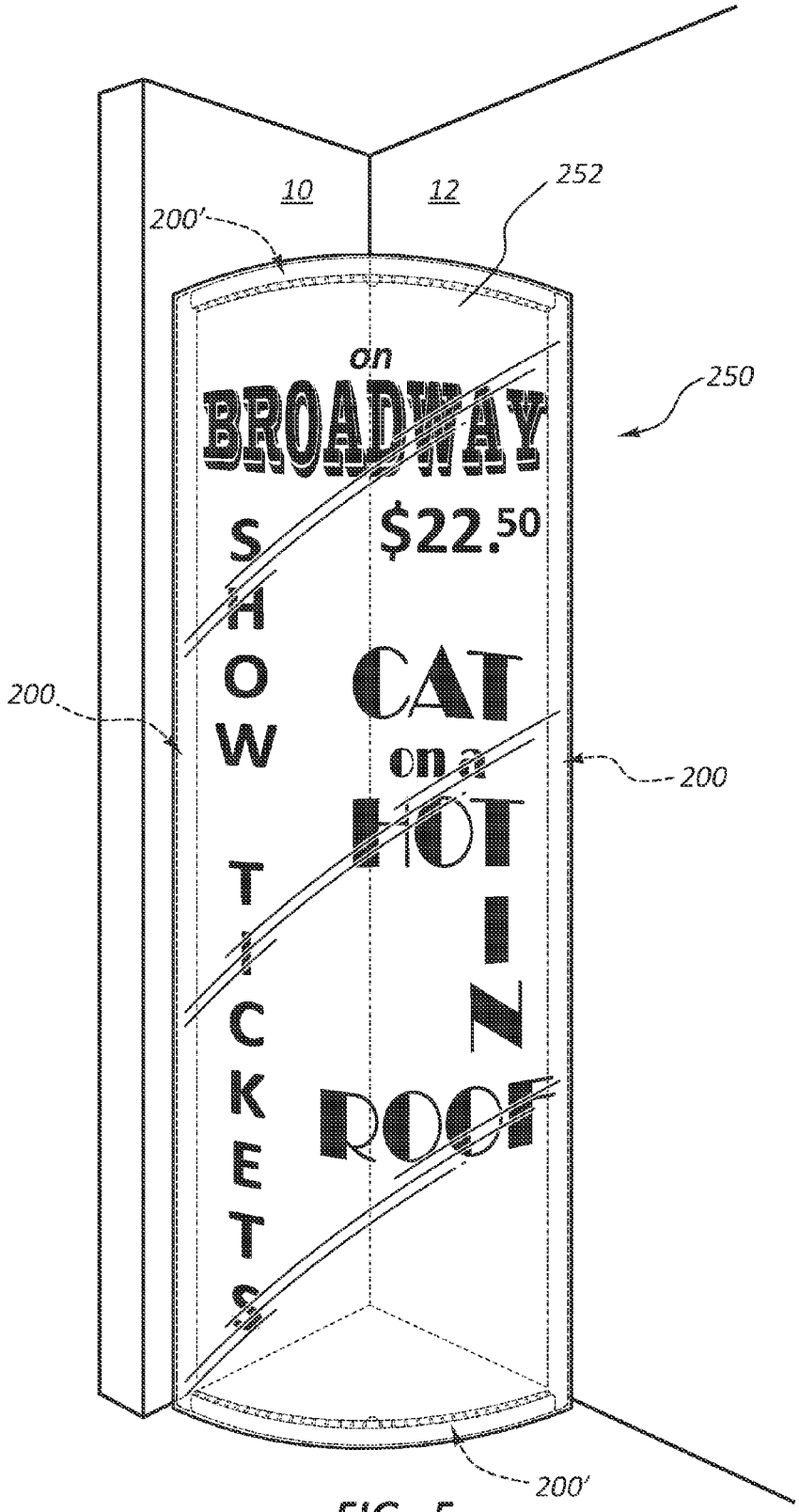
FIG. 5 is a perspective view of an exemplary graphic display system configured as a quarter cylinder.

FIG. 5 shows an exemplary graphic display system 250 similar to system 150 of FIGS. 4A-4C. Graphic display system 250 is shown as comprising a substantially quarter cylinder so as to easily fit into and fill a 90° corner defined between perpendicular walls 10 and 12. Such a graphic display system 250 is difficult if not impossible to achieve with traditional frame and stand support systems. Advantageously, such a configuration is easily achieved using curved substantially horizontal support devices 200' that provide a quarter turn and substantially vertical support devices 200. Such a configuration is easily pushed into a corner, and there is no frame or stand structure required beyond the bounds of the quarter cylinder display material 252 that would interfere with corner walls 10, 12 and the ability to position the graphic display system 250 in such a corner. In other words, the support members do not extend laterally outward any further than graphic display material 252, and only extend rearwardly a relatively short distance, so that no space requirements beyond that available within such a 90° corner are required. Graphic sheet 250 may be pressed against walls 10 and 12, requiring no distance between graphic sheet 252 and walls 10, 12.

Figure 6:
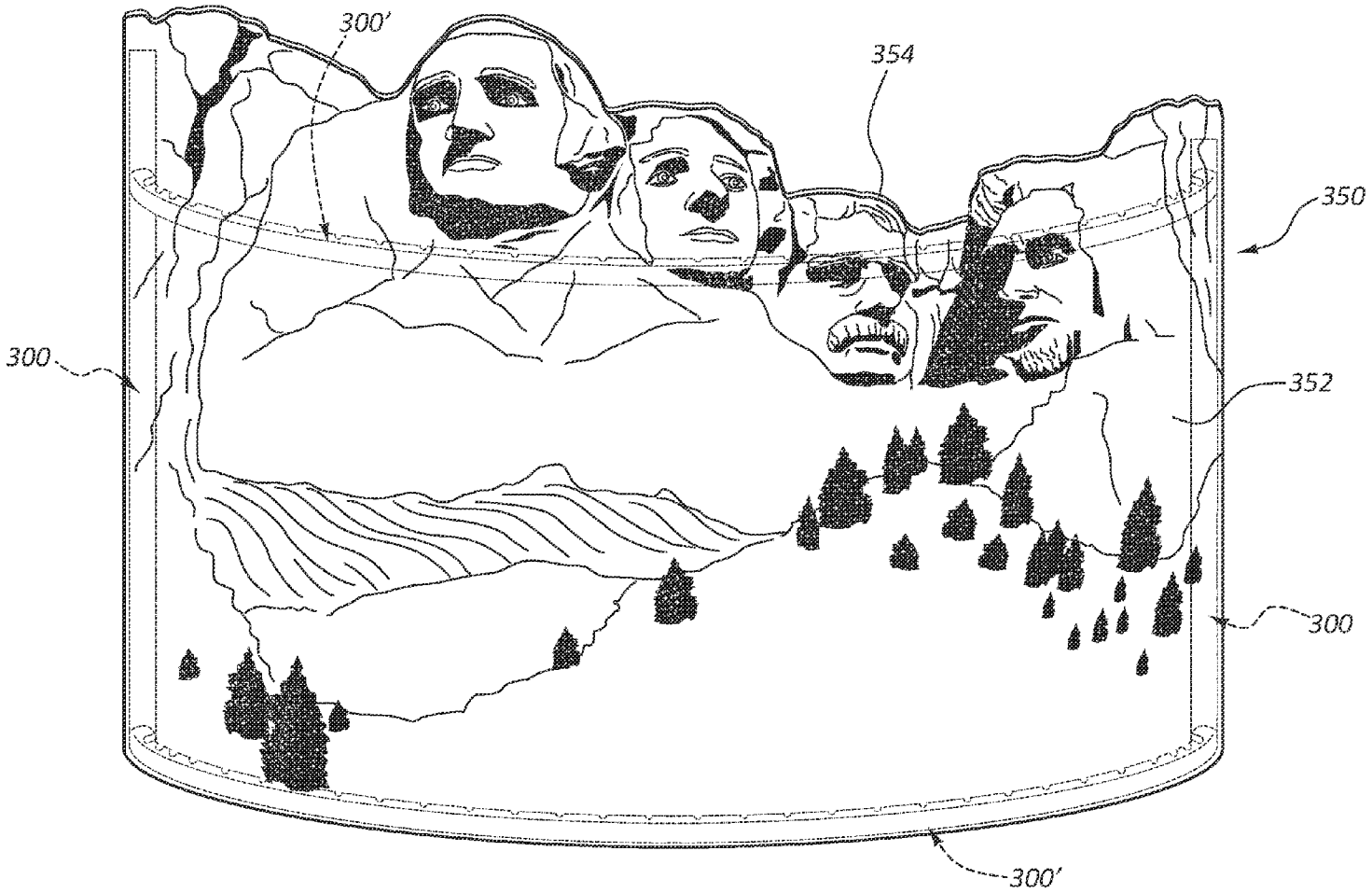
FIG. 6 is a perspective view of an exemplary graphic display system including an irregular top surface.

FIG. 6 shows another exemplary graphic display system 350 that may be supported in a similar manner as described above. Graphic display system 350 is shown as including an irregular top surface 354, which surface can be difficult if not impossible to adequately support with traditional frame and stand support systems. Advantageously, such a configuration is easily achieved and supported by positioning a curved substantially horizontal support 300' along a top portion of the graphic display material 352 (e.g., just below the shortest extension of irregular top surface 354). Substantially vertical support devices 300 may also be employed, in a similar manner as shown in FIGS. 4A-4C.

Figure 7A:
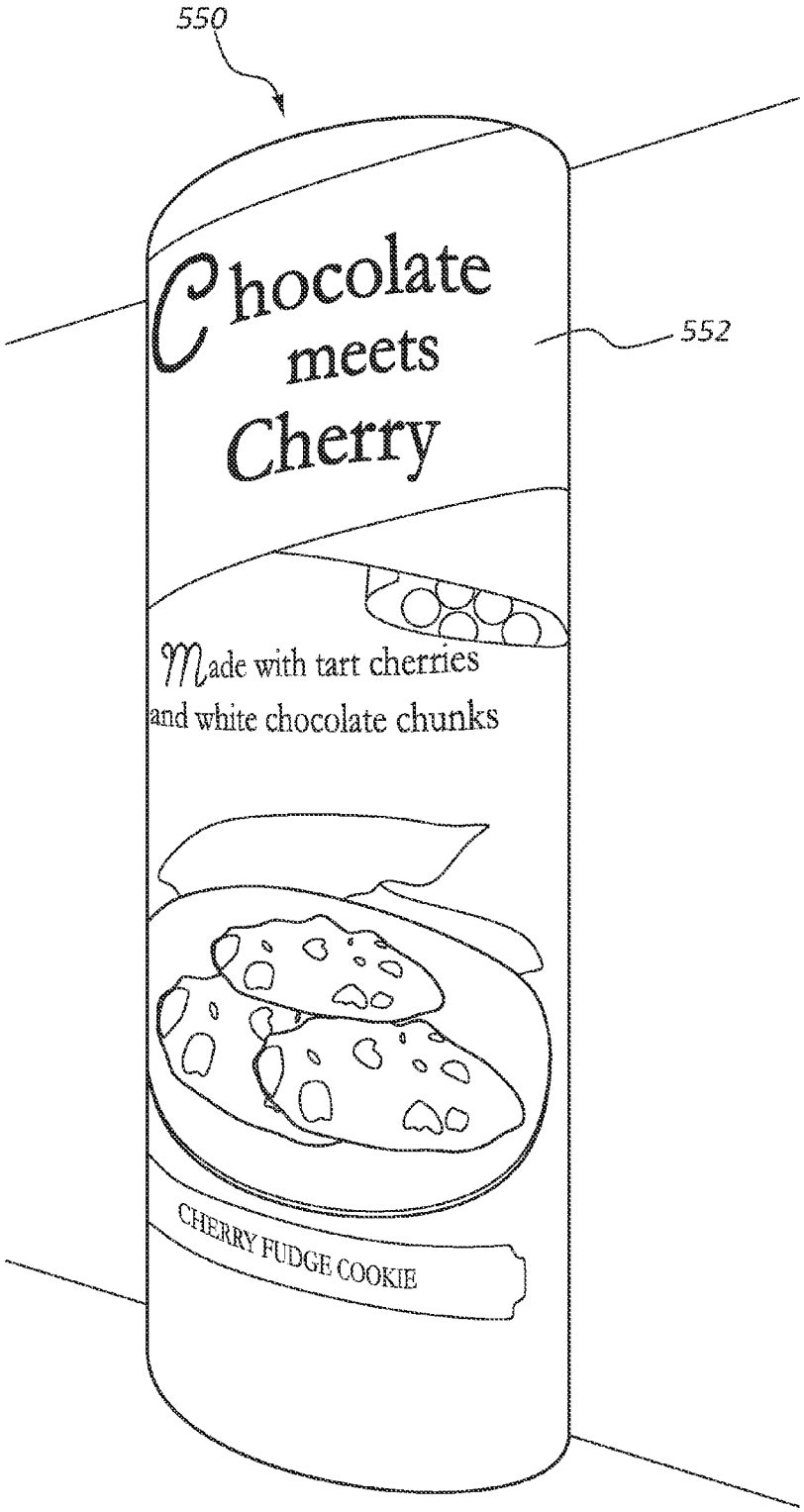
FIG. 7A is a front perspective view of a curved graphic display system including a non-uniform radius of curvature.
Figure 7B:
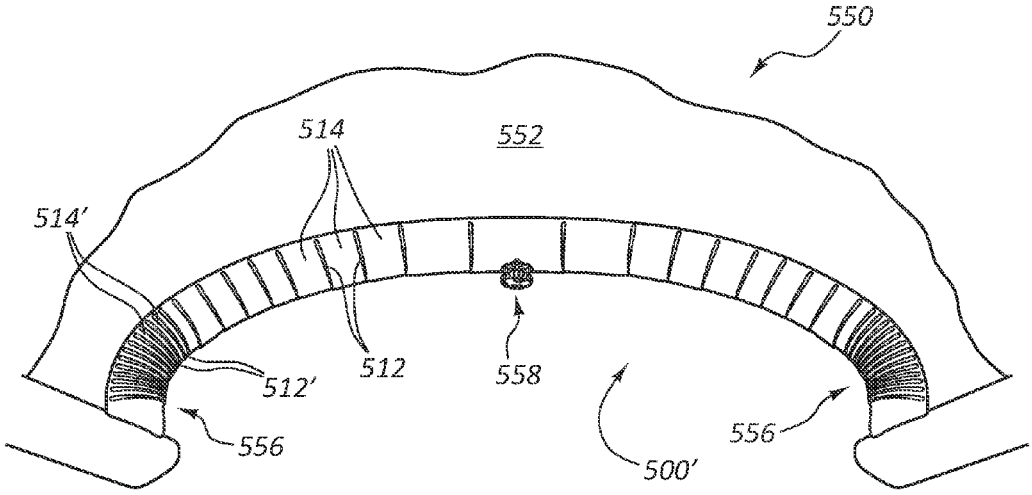
FIG. 7B is a rear perspective view of a portion of the graphic display system of FIG. 7A showing non-uniform spacing of the plurality of transverse recesses in the support device to better accommodate the non-uniform radius of curvature.
Figure 7C:
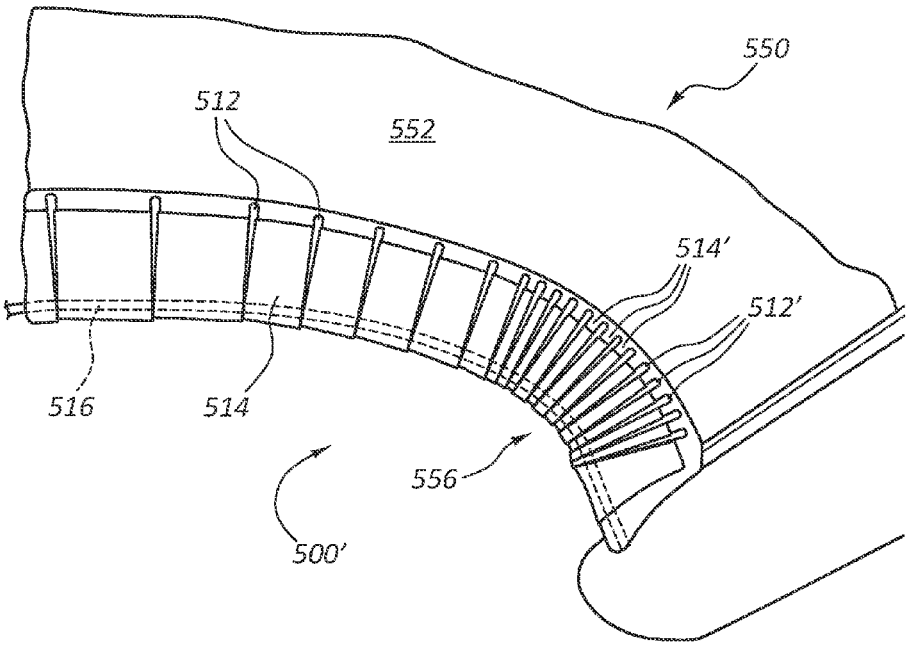
FIG. 7C is a close up perspective view of a portion of the graphic display system and support device of FIG. 7B.

FIGS. 7A-7C illustrate aspects of another graphic display system 550. Graphic display system 550 includes varying radii of curvature within the support device 500'. For example, in the illustrated configuration, the radius of curvature is smaller (i.e., tighter) adjacent ends 556 (FIG. 7B) than at a center portion 558, which includes a relatively larger radius of curvature. FIGS. 7B and 7C show support device 500', which provides for such a configuration by varying the spacing between slots. Because the spacing between slots or recesses 512 and 512' is not substantially equal, support device 500' includes relatively longer sections 514, as well as relatively shorter sections 514'. As shown, relatively longer sections may be disposed adjacent center portion 558, while shorter sections are disposed adjacent ends 556 of support device 500'. Closer positioning of adjacent recesses allows support device 500' to curve with a tighter radius of curvature in the regions where positioning of recesses is more dense. Graphic display material 552 thus assumes a curved configuration in which the radius or curvature is not constant.

Figure 8:
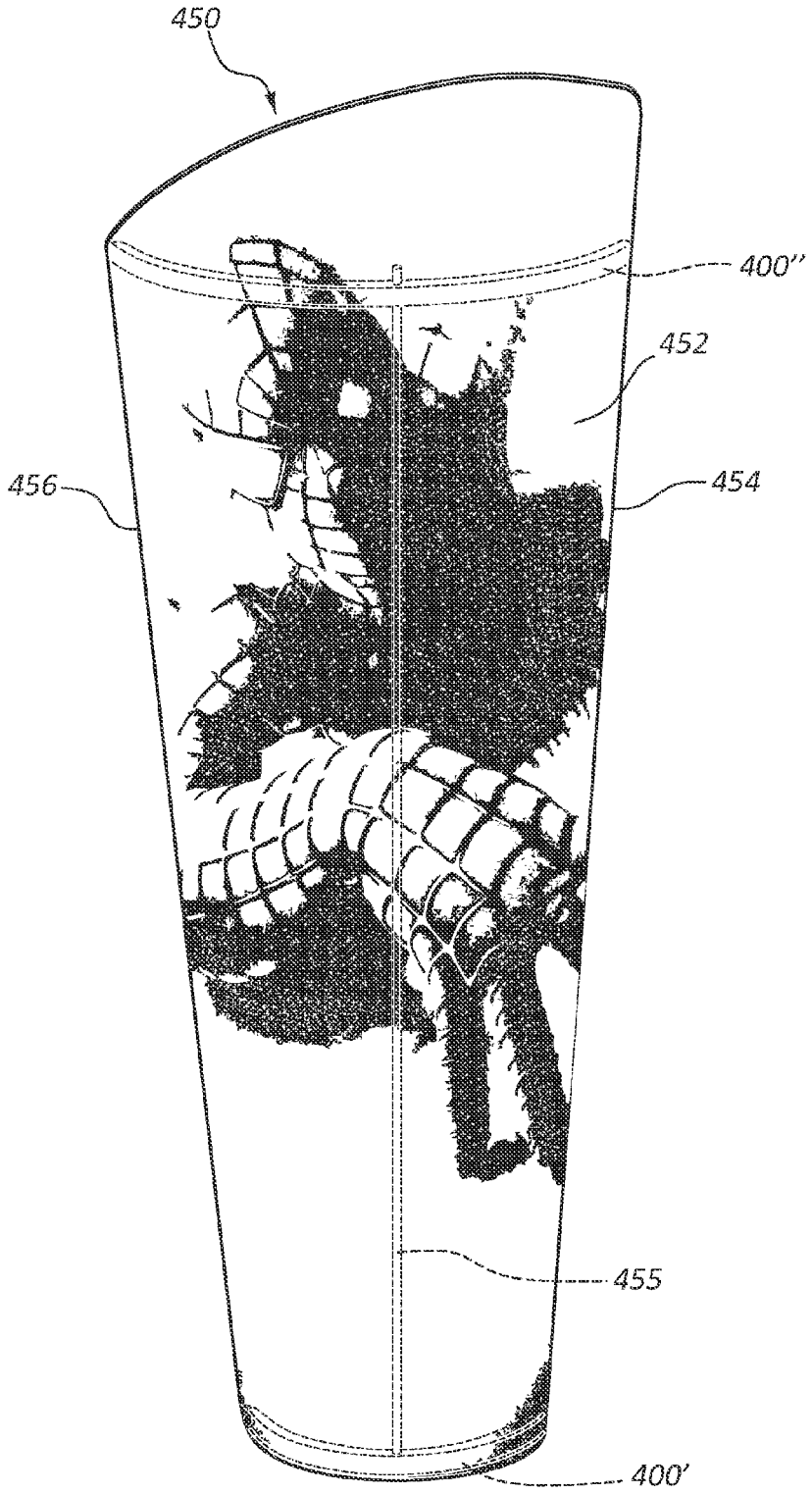
FIG. 8 is a front perspective view of an exemplary graphic display system with a tight radius of curvature at its base and a more shallow radius of curvature at a top portion thereof.

Configurations including recesses that are at a non-perpendicular angle relative to a longitudinal axis of the elongate body may be beneficial when it is desired to impose an axial twist on the support device. FIG. 8 shows such a graphic display system. Support member 400' at the bottom of graphic display system 450 may include recesses so as to allow it to assume a desired curvature. Support member 400" attached near a top of display system 450 that supports the top of graphic display sheet 452 may include transverse recesses in which at least some of the transverse recesses are oriented at a non-perpendicular angle relative to a longitudinal axis of the elongate body of support device 400" to cause support device 400" to have a desired axial twist sufficient to prevent a kink within graphic display sheet 452 as it extends from bottom support device 400' to top support device 400". Such an axial twist may be helpful in preventing formation of a kink within sheet 452 where bottom support device 400' defines a relatively tight radius of curvature and upper support device 400" defines a shallower radius of curvature. The presence of recesses that are non-perpendicularly angled relative to a longitudinal axis of the elongate body in support device 400" provides the ability to achieve axial twisting to better match the natural angle of the graphic display sheet 452, so as to provide a smooth surface and prevent kinking, buckling, or bulging within the graphic display sheet 452.

The side edges 454 and 456 of graphic display sheet 452 may be free, unattached to any vertical support devices. A central substantially linear and rigid elongate support member 455 may be provided to provide vertical support to sheet 452. Such a linear and rigid elongate support member may comprise a support device such as device 100 shown in FIG. 1 or it may simply comprise a rod formed of metal, plastic, or other rigid material. Ends of such a rod may be inserted through holes formed in the upper and lower support devices 400' and 400". Rod 455 may include collars near a top a bottom, or both to prevent support devices 400' and 400" from sliding up or down rod 455.

FIG. 9 shows an exemplary support device 500' including recesses 512 that are oriented at an angle that is substantially perpendicular relative to a longitudinal axis of elongate body 502, as well as recesses 512' that are oriented at a non-perpendicular angle relative to the longitudinal axis of body 502. The illustrated embodiment thus includes recesses 512 and associated sections 514 that are oriented substantially perpendicular to the longitudinal axis and recesses 512' and associated sections 514' that are oriented non-perpendicularly relative to the longitudinal axis. Non-perpendicular recesses 512' may be positioned anywhere along a length of support device 500' so as to achieve a desired axial twisting characteristic adjacent the non-perpendicular recesses 512'. In one embodiment, a support device may include only non-perpendicular recesses.

While transverse recesses or slots within the various support devices are shown as being substantially linear, in one embodiment, at least one of the recesses or slots may be curved.

Individual concave or convex graphic display systems (e.g., such as any of those shown in FIG. 4A-4C, 5, 6, 7A, or 8) may be positioned end to end, creating an undulating type structure of alternating concave and convex portions. Each individual graphic display system or "panel" may be disassembled and its components rolled for storage or transport. If desired, multiple "panels" may be rolled together. When assembled, individual "panels" of an overall graphic display system employing multiple "panels" may be connected together, if desired.

FIGS. 10A-10D show an exemplary ratchet device 175 that may be employed with an elongate tensioning member (e.g., a string) 116 to maintain the support devices in a desired curved configuration. Ratchet device 175 includes a handle 172, a ratchet wheel 174, and a spool 176.

Handle 172 may include inwardly oriented projections 178 configured to engage between teeth 180 of ratchet wheel 174. Projections 178 and teeth 180 may be formed to extend at an angle other than perpendicular relative to a base where they extend from the handle 172 or ratchet wheel 174, respectively. In one embodiment, they may be angled in opposite directions (e.g., projections 178 may be angled counter clockwise as viewed from above, while teeth 180 may be angled clockwise as viewed from above). The opposite angulation of projections 178 and teeth 180 provides engagement of projections 178 between teeth 180, allowing wheel to be rotated one direction only when projections and teeth are engaged. For example, the illustrated configuration allows rotation of handle 172 in a clockwise direction, but prevents rotation in a counterclockwise direction relative to ratchet wheel 174 when projections 178 are engaged between teeth 180.

A distal end of handle 172 may include a central shaft 182 including a plurality of teeth 184 extending from an exterior surface thereof configured to engage with corresponding teeth 186 extending inwardly from hollow spool 176. Such a configuration couples rotation of shaft 182 and handle 172 to spool 176, so that rotation of handle 172 causes rotation of spool 176. Central shaft 182 may include a distal portion 188 that includes no teeth 184 so that if handle 172 is pulled upwardly, teeth 184 disengage from teeth 186, freeing spool 176 to rotate freely. Alternative to including no teeth on a distal portion 188, an internal surface of spool 176 may include a proximal portion which includes no teeth, so that in either case, engagement between teeth 184 and 186 only occurs where handle 172 is fully seated.

In use, an elongate tensioning member 116 is spooled about spool 176, with opposing ends exiting ratchet device through holes or channels 190 on opposite sides of a ratchet device housing (e.g., housing members 192 and 194). Clockwise rotation of handle 172 spools elongate tensioning member 116 about spool 176, increasing the tension on elongate tensioning member 116. Because of the engagement between projections 178 and teeth 180, handle 172 is prevented from slacking the applied tension, as handle 172 does not rotate counterclockwise when thus engaged. In order to release the tension on elongate tensioning member 116, one pulls up on handle 172, causing external teeth 184 of shaft 182 of handle 172 to disengage from internal teeth 186 of spool 176. In this state, spool 176 is then free to rotate so as to release tension within spooled elongate tensioning member 116.

Of course, other ratchet devices or tensioning devices for applying and maintaining tension on elongate tensioning member 116 may alternatively be employed. Examples of suitable ratchet devices are disclosed in the Boa Technology, Inc. patents already incorporated by reference herein. In light of the present disclosure, other suitable ratchet devices and tensioning devices will be apparent to one of skill in the art.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A support device for supporting a graphic display, the support device comprising:

a thin-walled, elongate body having a length extending between first and second ends and having first and second side edges extending along the length of the elongate body;

wherein the first and second side edges comprise at least one recess or protrusion for selectively locking the first and second side edges together so as to selectively orient the elongate body in an elongate tube-shaped configuration when the first and second side edges are selectively locked together;

wherein the thin-walled, elongate body is sufficiently flexible so that when the first and second side edges are disengaged from each other the elongate body can be rolled along its length into a tube-shaped configuration for storage;

wherein the elongate body includes a plurality of transverse recesses formed along its length to assist the support device in assuming a curved configuration; and wherein the transverse recesses are spaced apart so as to cause the support device to have a desired radius of curvature.

2. A support device as in claim 1, wherein one side edge comprises a lateral protrusion forming a recess configured to receive a corresponding portion of the other side edge when selectively locking the first and second side edges together.

3. A support device as in claim 2, wherein the lateral protrusion comprises a more flexible material than a material comprising the thin-walled, elongate body.

4. A support device as in claim 1, further comprising a bend line in the thin-walled, elongate body along its length and between the first and second side edges.

5. A support device as in claim 4, wherein when the first and second side edges are locked together the resulting tube-shaped configuration is substantially D-shaped where a first portion of the elongate body forms a curved outer face of the substantially D-shaped configuration and a second portion of the elongate body forms an essentially flat portion of the substantially D-shaped configuration.

6. A support device as in claim 5, wherein the first portion has a width that is about 125% to about 300% of a width of the second portion.

7. A support device as in claim 1, wherein at least some of the transverse recesses are oriented substantially perpendicular relative to a longitudinal axis of the elongate body.

8. A support device as in claim 1, wherein at least some of the transverse recesses are oriented at a non-perpendicular angle relative to a longitudinal axis of the elongate body to cause the support device to have a desired axial twist.

9. A support device as in claim 1, wherein at least some of the transverse recesses are spaced apart at equal distances to cause the support device to have a single radius of curvature along the length of the elongate body.

10. A support device as in claim 1, wherein at least some of the transverse recesses are spaced apart at unequal distances to cause the support device to have varying radii of curvature along the length of the elongate body.

11. A support device as in claim 10, wherein spacing between transverse recesses near one or both ends of the elongate body is smaller as compared to spacing between transverse recesses in a centrally disposed region of the elongate body.

12. A support device as in claim 1, further comprising an elongate tensioning member extending at least partially between the first and second ends of the elongate body to selectively apply tension for maintaining the support device in a desired curved configuration.

13. A support device as in claim 12, wherein the elongate tensioning member is selected from the group consisting of an elastic band, a rope, a cord, a string, a monofilament, and combinations thereof.

14. A support device as in claim 13, further comprising a ratchet device for applying tension to the elongate tensioning member.

15. A support device as in claim 14, wherein the ratchet device comprises:

a handle including inwardly oriented projections and a central shaft including a proximal portion with teeth formed on an exterior surface thereof;

a ratchet wheel including teeth configured to engage with the projections of the handle to allow rotation of the handle in only a single direction when the projections engage the teeth of the ratchet wheel; and a spool disposed about the central shaft of the handle, the spool including a hollow channel for receiving the central shaft of the handle, an interior surface of the spool including teeth formed therein to selectively engage with the teeth of the central shaft of the handle, wherein the teeth of the central shaft of the handle selectively engage the teeth of the spool to allow the elongate tensioning member to be selectively spooled about the spool, and wherein upon pulling the handle relative to the spool, the teeth of the central shaft disengage from the teeth of the spool, releasing any tension applied to the elongate tensioning member spooled about the spool.

16. A graphic display system comprising:

a thin-walled graphic display sheet that is sufficiently flexible so that the graphic display sheet can be rolled into a tube-shaped configuration during storage; and at least one support device for supporting the graphic display sheet in a desired configuration during use, the support device comprising:

a thin-walled, elongate body having a length extending between first and second ends and having first and second side edges extending along the length of the elongate body;

wherein the first and second side edges comprise at least one recess or protrusion for selectively locking the first and second side edges together so as to selectively orient the elongate body in an elongate tube-shaped configuration when the first and second side edges are selectively locked together; and wherein the thin-walled, elongate body is sufficiently flexible so that when the first and second side edges are disengaged from each other the elongate body can be rolled along its length into a tube-shaped configuration for storage.

17. A graphic display system as in claim 16, wherein the support device can be rolled along its length into a tube-shaped configuration when attached to the graphic display sheet.

18. A graphic display system as recited in claim 16, wherein the support device has a substantially D-shaped configuration when holding the graphic display in the desired configuration during use.

19. A graphic display system as recited in claim 16, wherein at least part of the graphic display sheet is curved when in the desired configuration during use, and wherein the elongate body of a first support device includes a plurality of transverse recesses formed along its length to assist the support device in assuming a curved configuration.

20. A graphic display system as recited in claim 19, further comprising a substantially linear and rigid elongate support member for holding the graphic display sheet in a desired vertical orientation relative to a support surface.

21. A graphic display system as recited in claim 20, wherein the substantially linear and rigid elongate support member comprises a metal rod.

22. A graphic display system as recited in claim 20, wherein the substantially linear and rigid elongate support member comprises a second support device and wherein the first support device is positioned substantially horizontally relative to the graphic display sheet.

23. A system as recited in claim 16, wherein at least one of a top, bottom, or side edge of the graphic display sheet forms an irregular edge.

24. A method of setting up a graphic display system comprising:

providing a graphic display assembly in an initially rolled-up configuration, the graphic display assembly comprising a rollable graphic display sheet and one or more rollable support devices for supporting the graphic display sheet in a desired configuration during use;

unrolling the graphic display assembly; and engaging interlocking side edges of the one or more rollable support devices to form one or more assembled support devices having a tube-shaped configuration;

the one or more assembled support devices maintaining the graphic display sheet in a desired configuration during use.

25. A method as recited in claim 24, wherein the one or more rollable support devices are attached to the rollable graphic display sheet when the graphic display assembly is in the initially rolled-up configuration.

26. A method as recited in claim 24, wherein the graphic display assembly is contained within a storage tube when in the initially rolled-up configuration, the method further comprising removing the graphic display assembly from the storage tube prior to unrolling.

27. A method as recited in claim 24, further comprising disengaging the side edges of the one or more rollable support devices, rolling up the graphic display assembly, and positioning the rolled-up the graphic display assembly within a storage tube.

28. A method as recited in claim 24, wherein at least one of the one or more rollable support devices includes a plurality of transverse recesses along its length to assist the support device in assuming a curved configuration.

29. A method as recited in claim 28, further comprising applying tension between first and second ends of the at least one support device to cause it to assume a curved configuration.

30. A method as recited in claim 29, wherein the tension is applied using a ratchet device attached to an elongate tensioning member selected from the group consisting of an elastic band, a rope, a cord, a string, a monofilament, and combinations thereof.

31. A support device for supporting a graphic display, the support device comprising:

a thin-walled, elongate body having a length extending between first and second ends and having first and second side edges extending along the length of the elongate body;

wherein the first and second side edges comprise at least one recess or protrusion for selectively locking the first and second side edges together so as to selectively orient the elongate body in an elongate tube-shaped configuration when the first and second side edges are selectively locked together;

wherein the thin-walled, elongate body is sufficiently flexible so that when the first and second side edges are disengaged from each other the elongate body can be rolled along its length into a tube-shaped configuration for storage; and wherein the elongate body is substantially continuous and devoid of transverse recesses so as to remain substantially straight when oriented in the elongate tube-shaped configuration.

32. A support device for supporting a graphic display comprising:

a thin-walled, elongate body having a length extending between first and second ends and having first and second side edges extending along the length of the elongate body;

wherein the first and second side edges comprise at least one recess or protrusion for selectively locking the first and second side edges together so as to selectively orient the elongate body in an elongate tube-shaped configuration when the first and second side edges are selectively locked together;

wherein the thin-walled, elongate body is sufficiently flexible so that when the first and second side edges are disengaged from each other the elongate body can be rolled along its length into a tube-shaped configuration for storage; and wherein the first side edge comprises a lateral protrusion forming an acute angle with an adjacent region of the thin-walled, elongate body so as to form a recess configured to receive and overlap a portion of the second side edge when selectively locking the first and second side edges together.

33. A support device as in claim 32, wherein the lateral protrusion comprises a first material having a durometer that is less than a durometer of a second material comprising a remaining portion of the thin-walled, elongate body.

34. A support device as in claim 32, wherein the lateral protrusion comprises a first plastic material and a remaining portion of the thin-walled, elongate body comprises a second plastic material that differs from the first plastic material.

* * * * *

UNITED STATES PATENT AND TRADEMARK OFFICE

CERTIFICATE OF CORRECTION

PATENT NO. : 8,763,291 B1
APPLICATION NO. : 13/624707
DATED : July 1, 2014
INVENTOR(S) : John A. Nichols It is certified that error appears in the above-identified patent and that said Letters Patent is hereby corrected as shown below:

In the Specification

Column 2
Line 31, change "an desired configuration" to --a desired configuration--

Signed and Sealed this
Twenty-fourth Day of February, 2015

Michelle K. Lee

Michelle K. Lee
*Deputy Director of the United States Patent and Trademark Office*